US010182619B2

(12) United States Patent
Mallen et al.

(10) Patent No.: US 10,182,619 B2
(45) Date of Patent: Jan. 22, 2019

(54) ARTICLE OF FOOTWEAR INCORPORATING A WOVEN OR NON-WOVEN TEXTILE WITH DURABLE WATER REPELLANT PROPERTIES

(71) Applicant: NIKE, Inc., Beaverton, OR (US)

(72) Inventors: Sabrina P. Mallen, Portland, OR (US); Bhupesh Dua, Portland, OR (US); Erin Toraya, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/606,474

(22) Filed: Jan. 27, 2015

(65) Prior Publication Data

US 2015/0237960 A1 Aug. 27, 2015

Related U.S. Application Data

(60) Provisional application No. 61/942,683, filed on Feb. 21, 2014.

(51) Int. Cl.
*A43B 23/06* (2006.01)
*A43B 23/02* (2006.01)
(Continued)

(52) U.S. Cl.
CPC ..... *A43B 23/06* (2013.01); *A43B 1/04* (2013.01); *A43B 7/12* (2013.01); *A43B 23/0255* (2013.01);
(Continued)

(58) Field of Classification Search
CPC . A43B 23/06; A43B 23/0255; A43B 23/0265; A43B 23/042; A43B 1/04; A43B 1/12
See application file for complete search history.

(56) References Cited

U.S. PATENT DOCUMENTS 761,520 A * 5/1904 Matthew ..... B05D 1/26 12/146 C
3,484,881 A 12/1969 Krieger
(Continued)

FOREIGN PATENT DOCUMENTS

CN 101991209 A 3/2011
CN 102271548 A 12/2011
(Continued)

OTHER PUBLICATIONS

Notification of Transmittal of the International Search Report and the Written Opinion dated Apr. 29, 2015 in International No. PCT/US2015/014225.
(Continued)

*Primary Examiner* — Jila M Mohandesi
(74) *Attorney, Agent, or Firm* — Brinks Gilson & Lione

(57) ABSTRACT

A woven or non-woven textile for an upper of an article of footwear, methods for making the woven and non-woven textiles, and a method of making the article of footwear is described. The textile includes a first portion formed by a first yarn or fiber having durable water repellent properties and a second portion formed by a second yarn or fiber different from the first yarn or fiber. The second yarn or fiber is disposed along an edge portion of the textile configured to be attached to a sole structure to form an article of footwear. The woven textile is formed of unitary woven construction, and the non-woven textile is formed of unitary non-woven construction.

6 Claims, 30 Drawing Sheets

(51) Int. Cl.

| | |
|---|---|
| ***A43B 1/04*** | (2006.01) |
| ***A43B 7/12*** | (2006.01) |
| ***A43B 23/04*** | (2006.01) |
| ***D03D 1/00*** | (2006.01) |
| ***D03D 15/00*** | (2006.01) |
| ***D04H 13/00*** | (2006.01) |
| ***D04B 1/22*** | (2006.01) |

(52) U.S. Cl.

CPC ..... *A43B 23/0265* (2013.01); *A43B 23/042* (2013.01); *D03D 1/00* (2013.01); *D03D 15/00* (2013.01); *D04B 1/22* (2013.01); *D04H 13/00* (2013.01); *D10B 2401/021* (2013.01); *D10B 2403/032* (2013.01); *D10B 2501/043* (2013.01)

(56) References Cited

U.S. PATENT DOCUMENTS

| | | | | |
|---|---|---|---|---|
| 3,605,294 | A * | 9/1971 | Cunningham et al. | A43B 1/0072 12/146 C |
| 4,899,411 | A | 2/1990 | Johnson et al. | |
| 5,271,780 | A * | 12/1993 | Baigas, Jr. | D04H 1/64 156/276 |
| 5,345,638 | A * | 9/1994 | Nishida | A41H 3/08 12/146 C |
| 5,516,476 | A | 5/1996 | Haggard et al. | |
| 5,851,562 | A | 12/1998 | Haggard et al. | |
| 5,932,056 | A * | 8/1999 | Mark | A41D 31/02 156/266 |
| 6,299,962 | B1 * | 10/2001 | Davis | A43B 23/0255 12/142 P |
| 6,874,252 | B2 | 4/2005 | Nakano | |
| 6,931,762 | B1 | 8/2005 | Dua | |
| 7,347,011 | B2 * | 3/2008 | Dua | A43B 1/04 36/10 |
| 7,730,640 | B2 | 6/2010 | Clark et al. | |
| 8,490,299 | B2 | 7/2013 | Dua et al. | |
| 8,800,606 | B2 | 8/2014 | Cross et al. | |
| 8,839,532 | B2 | 9/2014 | Huffa et al. | |
| 2004/0118018 | A1 * | 6/2004 | Dua | A43B 1/04 36/45 |
| 2005/0066547 | A1 | 3/2005 | Al-Rasheed | |
| 2005/0208860 | A1 * | 9/2005 | Baron | A41D 27/28 442/414 |
| 2007/0245595 | A1 * | 10/2007 | Chen | A43B 7/08 36/45 |
| 2008/0052957 | A1 | 3/2008 | Taheri | |
| 2008/0110048 | A1 | 5/2008 | Dua et al. | |
| 2008/0110051 | A1 | 5/2008 | Min | |
| 2008/0127426 | A1 | 6/2008 | Morlacchi et al. | |
| 2010/0011624 | A1 | 1/2010 | Polegato Moretti | |
| 2010/0115792 | A1 | 5/2010 | Muller | |
| 2010/0154256 | A1 | 6/2010 | Dua | |
| 2010/0199406 | A1 * | 8/2010 | Dua | A43B 1/04 2/115 |
| 2010/0293812 | A1 | 11/2010 | Coulson | |
| 2011/0000106 | A1 | 1/2011 | Baychar | |
| 2011/0239485 | A1 | 10/2011 | Hooper et al. | |
| 2012/0030885 | A1 | 2/2012 | Moretti | |
| 2012/0073164 | A1 | 3/2012 | Linth et al. | |
| 2012/0233882 | A1 | 9/2012 | Huffa et al. | |
| 2012/0234052 | A1 | 9/2012 | Huffa et al. | |
| 2012/0255201 | A1 | 10/2012 | Little | |
| 2013/0036628 | A1 | 2/2013 | Hussey et al. | |
| 2013/0051706 | A1 | 2/2013 | Roether et al. | |
| 2013/0059116 | A1 * | 3/2013 | Peikert | A43B 7/125 428/138 |
| 2013/0186054 | A1 | 7/2013 | Dua et al. | |
| 2013/0186505 | A1 | 7/2013 | Cross et al. | |
| 2013/0186506 | A1 | 7/2013 | Cross et al. | |
| 2013/0189890 | A1 | 7/2013 | Cross et al. | |
| 2013/0190917 | A1 | 7/2013 | Cross et al. | |
| 2013/0247414 | A1 * | 9/2013 | Bier | A43B 7/08 36/45 |
| 2013/0260104 | A1 | 10/2013 | Dua et al. | |
| 2014/0173933 | A1 | 6/2014 | Bell | |
| 2014/0182168 | A1 | 7/2014 | Aver et al. | |
| 2015/0237948 | A1 | 8/2015 | Mallen et al. | |

FOREIGN PATENT DOCUMENTS

| | | | |
|---|---|---|---|
| CN | 102292487 | A | 12/2011 |
| CN | 202425687 | U | 9/2012 |
| CN | 104106883 | A | 10/2014 |
| DE | 10343620 | A1 | 4/2005 |
| EP | 2649898 | | 10/2013 |
| FR | 2572426 | | 2/1986 |
| GB | 1098441 | | 10/1968 |
| GB | 2416781 | | 8/2006 |
| JP | 1056005 | | 2/1998 |
| KR | 10-1240490 | B1 | 3/2013 |
| TW | 200840500 | | 10/2008 |
| TW | M515789 | | 1/2016 |

OTHER PUBLICATIONS

Notification of Transmittal of the International Search Report and the Written Opinion dated Apr. 29, 2015 in International No. PCT/US2015/014218.

Office Action and translated relevant portion from corresponding Chinese Application No. 201510083601.8, dated Apr. 5, 2016, 6 pages.

International Preliminary Report on Patentability from PCT/US2015/014225, dated Aug. 23, 2016, 12 pages.

U.S. Appl. No. 61/745,269, filed Dec. 21, 2012.

Haggard, "Hills' Quick Color Change Technology", Nov. 2002, C:\Users\awilkie\AppData\Local\Microsott \Windows\Temporary Internet Files\OLK2B69\Introduction to QCCT 2.doc Jan. 28, 2013, 4 pgs.

Office Action and English translation for corresponding ROC (Taiwan) Application No. 104105721 dated Dec. 8, 2016, 33 pages.

Office Action and English translation for ROC (Taiwan) Application No. 104105719 dated Jan. 4, 2017, 39 pages.

Office Action and English translation for ROC (Taiwan) Application No. 104105721 dated Jun. 27, 2017, 10 pages.

Office Action and English translation for ROC (Taiwan) Application No. 104105719 dated May 5, 2017, 8 pages.

Office Action and English translation for ROC (Taiwan) Application No. 104105721 dated Jan. 10, 2018, 4 pages.

* cited by examiner

ARTICLE OF FOOTWEAR INCORPORATING A WOVEN OR NON-WOVEN TEXTILE WITH DURABLE WATER REPELLANT PROPERTIES

CROSS-REFERENCE TO RELATED APPLICATION

This non-provisional patent application claims the benefit of priority under 35 U.S.C. § 119(e) to U.S. Provisional Application Ser. No. 61/942,683, which was filed in the U.S. Patent and Trademark Office on Feb. 21, 2014, and entitled "An Article Of Footwear Incorporating A Knitted Component With Durable Water Repellant Properties," the disclosure of which application is entirely incorporated herein by reference.

BACKGROUND

The present disclosure relates generally to woven or non-woven textiles for an article of footwear. The present disclosure also relates to an article of footwear having an upper comprising the woven textile or non-woven textile. The present disclosure further is related generally to a method of weaving a woven textile, to a method for manufacturing a non-woven textile, and to a method of making an article of footwear having an upper comprising the woven textile or the non-woven textile.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

Reducing the number of material elements may require that one material element provide multiple and additional properties and characteristics sought by users. Thus, there exists a need in the art for articles of footwear comprising a minimum number of material elements while providing a number of properties and characteristics sought by users.

SUMMARY

Various configurations of an article of footwear may have an upper and a sole structure secured to the upper. The upper may incorporate a knitted component, a woven textile, or a non-woven textile.

In one aspect, the disclosure provides a knitted component for an upper of an article of footwear. The knitted component includes a first portion formed by a first yarn, the first yarn having durable water repellent properties. The knitted component also has a second portion formed by a second yarn. The second yarn is different from the first yarn. The second yarn is disposed along an edge portion of the knitted component configured to be attached to the sole structure. The knitted component including the first portion and the second portion is formed of unitary knit construction.

In another aspect, the disclosure comprises an article of footwear having an upper and a sole structure secured to the upper. The upper comprises a knitted component formed of unitary knit construction. The knitted component comprises a first portion formed by a first yarn having durable water repellent properties. The knitted component has a second portion formed by a second yarn, the second yarn being different from the first yarn. The second yarn is disposed along an edge portion of the knitted component configured to be attached to the sole structure.

The disclosure provides a method of knitting a knitted component for an upper of an article of footwear having an upper and a sole structure. The method includes knitting a first portion of the knitted component formed by a first yarn, the first yarn having durable water repellent properties, and knitting a second portion of the knitted component formed by a second yarn, the second yarn being different from the first yarn. The second portion is disposed along an edge portion of the knitted component and is configured to be attached to the sole structure.

The disclosure also provides a method of manufacturing an article of footwear having an upper and a sole structure. The method comprises knitting a knitted component formed of a unitary knit construction for incorporation into the upper. A first portion of the knitted component is formed by first yarn, the first yarn having durable water repellent properties. A second portion of the knitted component disposed along an edge portion of the knitted component and configured to be attached to the sole structure is formed by a second yarn. The second yarn is different from the first yarn. The sole structure is attached to the second portion of the knitted component.

In one aspect, the disclosure provides a woven textile for an upper of an article of footwear. The woven textile includes a first portion formed by a first yarn, the first yarn having durable water repellent properties. The woven textile also has a second portion formed by a second yarn. The second yarn is different from the first yarn. The second yarn is disposed along an edge portion of the woven textile configured to be attached to the sole structure. The woven textile including the first portion and the second portion is formed of unitary woven construction.

In another aspect, the disclosure comprises an article of footwear having an upper and a sole structure secured to the upper. The upper comprises a woven textile formed of unitary woven construction. The woven textile comprises a first portion formed by a first yarn having durable water repellent properties. The woven textile has a second portion formed by a second yarn, the second yarn being different from the first yarn. The second yarn is disposed along an edge portion of the knitted component configured to be attached to the sole structure.

The disclosure provides a method of weaving a woven textile for an upper of an article of footwear having an upper and a sole structure. The method includes weaving a first portion of the woven textile formed by a first yarn, the first yarn having durable water repellent properties, and weaving a second portion of the woven textile formed by a second yarn, the second yarn being different from the first yarn. The second portion is disposed along an edge portion of the woven textile and is configured to be attached to the sole structure.

The disclosure also provides a method of manufacturing an article of footwear having an upper and a sole structure. The method comprises weaving a woven textile formed of a unitary woven construction for incorporation into the upper. A first portion of the woven textile is formed by first yarn, the first yarn having durable water repellent properties. A second portion of the woven textile disposed along an edge portion of the woven textile and configured to be attached to the sole structure is formed by a second yarn. The second yarn is different from the first yarn. The sole structure is attached to the second portion of the knitted component.

In one aspect, the disclosure provides a non-woven textile for an upper of an article of footwear. The non-woven textile includes a first portion formed by a first fiber, the first fiber having durable water repellent properties. The non-woven textile also has a second portion formed by a second fiber. The second fiber is different from the first fiber. The second fiber is disposed along an edge portion of the non-woven textile configured to be attached to the sole structure. The non-woven textile including the first portion and the second portion is formed of unitary non-woven construction.

In another aspect, the disclosure comprises an article of footwear having an upper and a sole structure secured to the upper. The upper comprises a non-woven textile formed of unitary non-woven construction. The non-woven textile comprises a first portion formed by a first fiber having durable water repellent properties. The non-woven textile has a second portion formed by a second fiber, the second fiber being different from the first fiber. The second fiber is disposed along an edge portion of the non-woven textile configured to be attached to the sole structure.

The disclosure provides a method of manufacturing a non-woven textile for an upper of an article of footwear having an upper and a sole structure. The method includes manufacturing a first portion of the non-woven textile with a first fiber, the first fiber having durable water repellent properties, and manufacturing a second portion of the non-woven textile formed by a second fiber, the second fiber being different from the first fiber. The second portion is disposed along an edge portion of the non-woven textile and is configured to be attached to the sole structure.

The disclosure also provides a method of manufacturing an article of footwear having an upper and a sole structure. The method comprises manufacturing a non-woven textile formed of a unitary non-woven construction for incorporation into the upper. A first portion of the non-woven textile is formed by first fiber, the first fiber having durable water repellent properties. A second portion of the non-woven textile disposed along an edge portion of the non-woven textile and configured to be attached to the sole structure is formed by a second fiber. The second fiber is different from the first fiber. The sole structure is attached to the second portion of the non-woven textile.

Other systems, methods, features, and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
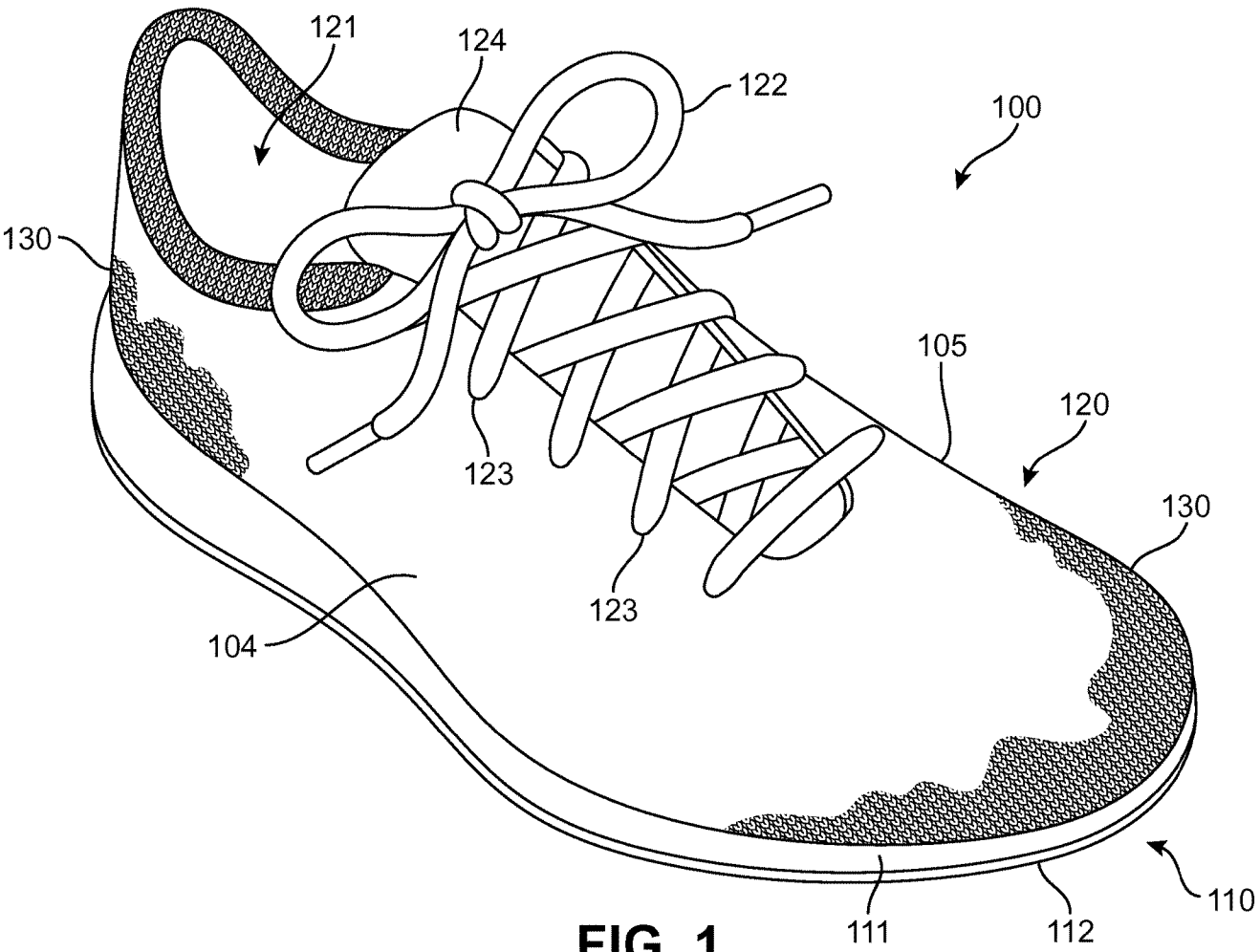
FIG. 1 is a perspective view of an exemplary embodiment of an article of footwear.

The disclosure is directed generally to an upper for an article of footwear, to an article of footwear having an upper and a sole structure secured to the upper; and to a method of producing the upper and a method of manufacturing an article of footwear having an upper and a sole structure. In particular, the upper may comprise a knitted component, a woven textile, or a non-woven textile. The knitted component may be made by knitting of yarn, the woven textile by weaving of yarn, and the non-woven textile by manufacture of a unitary non-woven web.

Although there are differences between the techniques by which the uppers disclosed herein may be made, there are many similarities. For example, use of any of the techniques may result in uppers having first portions and second portions, so uppers may differ only in appearance and technique by which the uppers are made. However, the remainder of the disclosures may be essentially identical. Features of the upper, the sole structure, and the method of manufacturing an article of footwear may be quite similar. Therefore, the disclosure will be described in detail as it relates to a knitted component for an upper, the associated article of footwear, and the related methods. Disclosure relating to woven and non-woven textiles will rely on this related disclosure regarding common similarity.

Knitted Components

In one aspect, the disclosure provides a knitted component for an upper of an article of footwear. The knitted component includes a first portion formed by a first yarn, the first yarn having durable water repellent properties. The knitted component also has a second portion formed by a second yarn. The second yarn is different from the first yarn. The second yarn is disposed along an edge portion of the knitted component configured to be attached to the sole structure. The knitted component including the first portion and the second portion is formed of unitary knit construction.

In another aspect, the disclosure comprises an article of footwear having an upper and a sole structure secured to the upper. The upper comprises a knitted component formed of unitary knit construction. The knitted component comprises a first portion formed by a first yarn having durable water repellent properties. The knitted component has a second portion formed by a second yarn, the second yarn being different from the first yarn. The second yarn is disposed along an edge portion of the knitted component configured to be attached to the sole structure.

The disclosure provides a method of knitting a knitted component for an upper of an article of footwear having an upper and a sole structure. The method includes knitting a first portion of the knitted component formed by a first yarn, the first yarn having durable water repellent properties, and knitting a second portion of the knitted component formed by a second yarn, the second yarn being different from the first yarn. The second portion is disposed along an edge portion of the knitted component and is configured to be attached to the sole structure The disclosure also provides a method of manufacturing an article of footwear having an upper and a sole structure. The method comprises knitting a knitted component formed of a unitary knit construction for incorporation into the upper. A first portion of the knitted component is formed by first yarn, the first yarn having durable water repellent properties. A second portion of the knitted component disposed along an edge portion of the knitted component and configured to be attached to the sole structure is formed by a second yarn. The second yarn is different from the first yarn. The sole structure is attached to the second portion of the knitted component.

Although the disclosure is described in detail as it relates to a knitted component for an upper for an article of footwear, the principles described herein may be applied to any textile element to provide durable water repellant properties to a portion of an object. For example, the principles may be applied to textiles including, but not limited to, knitted textiles, woven textiles, and non-woven textiles. Knitted textiles include textiles formed by way of warp knitting, weft knitting, flat knitting, circular knitting, and other suitable knitting operations. The knit textile may have a plain knit structure, a mesh knit structure, or a rib knit structure, for example. Woven textiles include, but are not limited to, textiles formed by way of any of the numerous weave forms, such as plain weave, twill weave, satin weave, dobbin weave, jacquard weave, double weaves, and double cloth weaves, for example. Non-woven textiles include textiles made by air-laid and spun-laid methods, for example. Additional disclosure relating to woven and non-woven textiles is set forth below.

One property or characteristic that may be desired by wearers of footwear is resistance to incursion of water and other liquids from outside the footwear. Water can enter footwear from many places. For example, any seam might leak and allow water into the footwear. Further, water may enter through the material of construction. In particular, web materials, such as knitted, woven, and/or nonwoven fabrics, may be more porous to incursion by water then other materials such as leather or synthetic leather. In some cases, such web materials may be used to form uppers for footwear that are lightweight.

Therefore, some consumers may treat footwear having an upper comprising a web material with a water repellent or waterproof composition. Imbuing a web material with water resistance can be particularly desirable for footwear made with yarn that is highly texturized. Such highly textured yarn has a high specific surface area and may tend to adsorb more water than an un-texturized yarn unless the yarn is coated or treated with a water-repellent material.

However, this technique typically may be less than satisfactory. Such consumer-applied treatments typically are unsatisfactory as it often is difficult to apply such materials in a manner that significantly reduces water incursion. Further, application of waterproofing or water repellent compositions may tend to make the footwear uncomfortable, heavy, inflexible, and unattractive, thus defeating the purpose of using the web material.

Another way to reduce water incursion through footwear uppers having a web material is to form the upper with a water-repellent material. Water-repellent materials may complicate manufacture of the article of footwear, however, particularly at the attachment of the upper to a sole structure. Many articles of footwear, especially footwear including web materials, such as a knitted component, typically are not the sewn to the sole structure. Rather, adhesive bonding often is used to join the parts.

Footwear uppers having a component made from material that is water-repellent may, therefore, serve to reduce undesirable water incursion into the footwear. Such material can be adhered to a sole structure with a solvent-based adhesive. However, solvent-based adhesives may face governmental regulation and may require special attention in usage and handling techniques. Hence, water-based adhesives typically are used. However, the water repellent nature of a knitted component in an upper made from water-repellent yarn generally precludes use of water-based adhesives to attach the upper to a sole structure.

Embodiments of the knitted component for incorporating into an upper disclosed herein having a first portion formed by yarn having durable water repellent properties provides reduced water incursion as compared with a typical knitted component. The disclosed knitted component also provides a second portion made from a yarn different from the yarn having durable water repellent properties. The second portion is disposed along an edge of the knitted component and provides a portion suitable for use with water-based adhesives. Water-based adhesives include adhesives that are soluble in water or that are carried in water, such as a suspension or dispersion of adhesive in water. Thus, the knitted component may be incorporated into an upper that is water-repellent and an article of footwear wherein the upper may be adhered to a sole structure with water-based adhesive. The resultant article of footwear disclosed herein thus provides the properties and characteristics sought by the wearer, such as comfort, flexibility, lateness, an attractive appearance, and reduced water incursion, yet may be assembled with water-based adhesives.

In some embodiments, a third portion of the knitted component may provide an area in which water-based indicia may be applied to an area of the knitted component that is visible when the knitted component is incorporated into the upper of an article of footwear. Water-based indicia include indicia that are soluble in water or that are carried in water, such as a suspension or dispersion of indicia in water. The third portion is made from a yarn that does not have durable water repellent property.

In some embodiments, a fourth portion of the knitted component may provide an area of the knitted component that serves as a rand. A rand is an area on an upper of an article of footwear that is located vertically above the biteline where the sole structure and upper are attached. A rand may be continuous around the upper, or may be discontinuous or located only in select areas. For example, in an exemplary embodiment, a rand may extend around the outer periphery of the upper through each of the forefoot portion, the midfoot portion, and the heel portion. In other embodiments, a rand may be present only on the forefoot portion of the upper. In still other embodiments, a rand may be present on the forefoot portion and the heel portion of the upper. A rand may comprise a material that provides properties and characteristics suited for that area of the article of footwear.

In some embodiments, a rand may be an area imbued with durable water repellant properties. Typically, in such an embodiment, at least some of the area of the upper adjacent the rand may be devoid of durable water repellant properties. In other embodiments, the rand may not be imbued with durable water repellant properties, whereas at least some of the upper adjacent the rand may have durable water repellant properties. A rand not imbued with durable water repellant properties may be suitable for application of coatings and other compositions enabling the rand to provide suitable protection from abrasion.

In some embodiments, a rand may be provided by knitting the fourth portion of the knitted component with appropriate material in a band extending continuously around the perimeter of an article of footwear above the biteline. In different embodiments, a rand may extend any distance above the biteline sufficient to provide water repellency at and above the biteline. With this configuration, a rand may be provided to an area of the upper that is disposed close to the sole structure.

Additionally, in some embodiments, the fourth portion of the knitted component may be present together with the third portion, as detailed above. In other embodiments, the fourth portion may be present in the absence of the third portion.

The yarns used in embodiments of the disclosure may be selected from monofilament yarns and multifilament yarns formed from natural or synthetic materials. Multifilament yarns may be twisted or untwisted. In some embodiments, yarn may be elastic or essentially inelastic. In some embodiments, yarn may be textured or have a natural finish. Natural materials may be selected from staple materials, such as silk, cotton, and wool. Synthetic materials may be selected from polymers that can be formed into filaments. Synthetic materials include but are not limited to polyesters; polyamides, such as any of the various types of homopolymeric and co-polymeric nylon; aramides, such as Kevlar® and Nomex®; and urethanes, such as thermoplastic polyurethane.

In embodiments of the disclosure, the first yarn having durable water repellent properties may be selected from yarns that meet design criteria and may incorporate yarns with different deniers, materials (e.g., cotton, elastane, polyester, rayon, wool, and nylon), and degrees of twist, for example. The different types of yarns may affect the physical properties of a knitted component, including aesthetics, stretch, thickness, air permeability, and abrasion-resistance. That is, the different types of yarns may impart different properties to different areas of the knitted component. By combining various types and combinations of stitches and yarns, each area of knitted component may have specific properties that enhance the comfort, durability, and performance of the article of footwear. In some configurations, multiple yarns with different colors may be utilized to form the knitted component. When yarns with different colors are twisted together and then knitted, the knitted component may have a heathered appearance with multiple colors randomly distributed throughout.

In embodiments of the disclosure, the yarns may be treated with a durable water repellence-providing composition during manufacture to yield yarn having durable water repellent properties. The yarn may be made by any suitable method. For example, a durable water repellence-providing composition may be applied in a batch process, wherein untreated yarn, for example on a beam, is passed through a bath of durable water repellence-providing composition, heat treated if necessary, and then wound onto a second beam. Another batch process may include dipping the quantity of yarn into a bath of durable water repellence-providing composition. Alternatively, durable water repellence-providing composition may be applied to the surface of a resin-based yarn formed by extrusion. Typically, in such a method, resin may be extruded to form a partially-oriented yarn. Partially-oriented yarn then may be texturized. Durable water repellence-providing composition may be applied to the yarn during or after texturization. The yarn then typically may be heat-treated and prepared for knitting.

In some embodiments, a resin may be imbued with durable water repellence properties during yarn manufacture by introducing a durable water repellence-providing composition from a masterbatch. A masterbatch is a mixture of a carrier resin having a high concentration of an additive. In embodiments herein, the carrier resin is a resin used to form a yarn, and the additive is the durable water repellant composition. A selected concentration of durable water repellence-providing material then is introduced into the carrier resin. The material in the carrier resin then is introduced into the bulk of the polymeric resin. The blend then is formed into yarn.

Another suitable yarn having durable water repellent properties may be a core and sheath-type bi-component yarn having a sheath of material having durable water repellent properties essentially concentric with and surrounding a core of yarn material. Other bi-component yarns, such as "islands in the sea" type, also may be suitable. Still another technique may be to spray durable water resistant composition onto yarn.

The durable water repellence-providing composition may be any composition that repels water and that can be durably associated with a yarn. For example, the durable water repellence-providing composition may be selected from any suitable water-repellent composition, such as but not limited to $C_4$, $C_6$, and $C_8$ fluorocarbons, silicones, waxes, a plasma coating, and durable water repellence-providing materials that remain bondable with adhesives. Durable water repellence-providing composition typically is heat-treated to cure the material. The heat cure may be carried out during steaming, and typically can be carried out during manufacture of the knitted component.

The following discussion and accompanying Figures disclose a variety of concepts relating to knitted components and the manufacture of knitted components. Although the knitted components may be utilized in a variety of products, an article of footwear that incorporates one of the knitted components is disclosed below as an example. The description will be directed in detail to an article of footwear. However, in addition to footwear, the knitted components may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g., bandages, swabs, and implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

Figure 2:
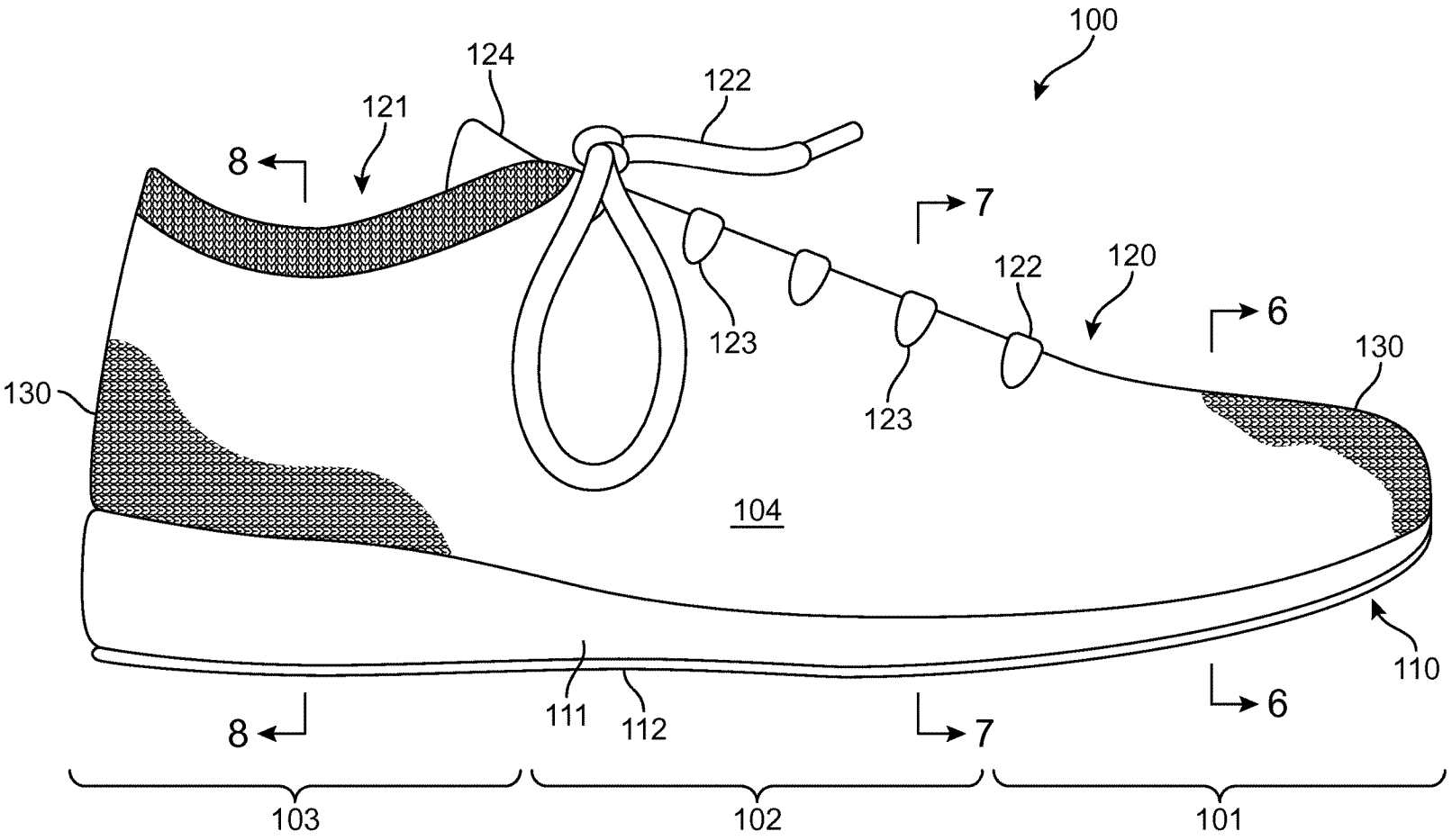
FIG. 2 is a lateral side elevational view of the exemplary embodiment of an article of footwear.
Figure 3:
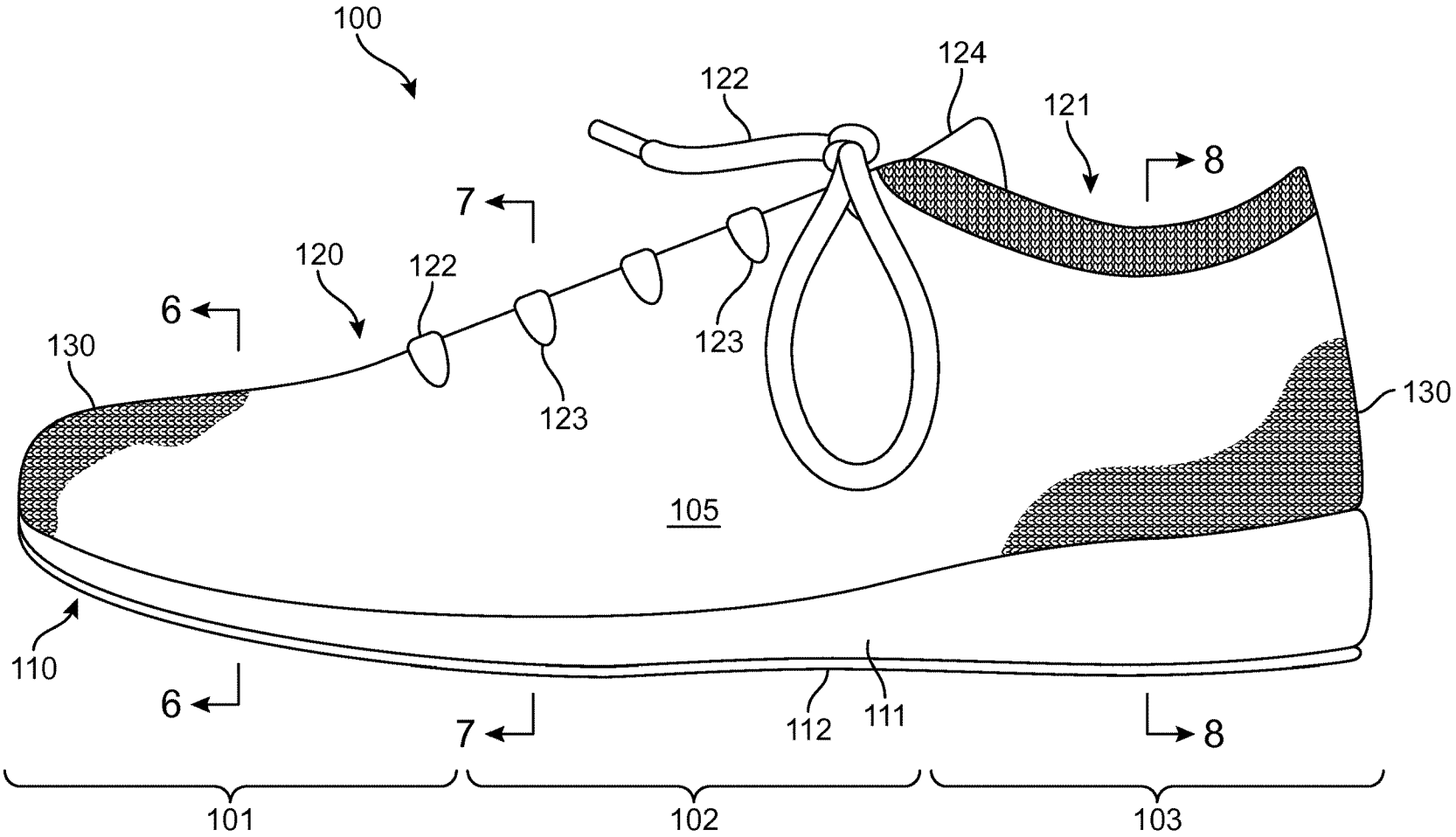
FIG. 3 is a medial side elevational view of the exemplary embodiment of an article of footwear.

An article of footwear 100 is depicted in FIGS. 1-3 as including a sole structure 110 and an upper 120. Although footwear 100 is illustrated as having a general configuration suitable for running, concepts associated with footwear 100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 100 apply to a wide variety of footwear types.

For reference purposes, footwear 100 may be divided into three general regions: a forefoot region 101, a midfoot region 102, and a heel region 103. Forefoot region 101 generally includes portions of footwear 100 corresponding with the toes and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of forefoot region 101, midfoot region 102, and heel region 103 and correspond with opposite sides of footwear 100. More particularly, lateral side 104 corresponds with an outside area of the foot (i.e., the surface that faces away from the other foot), and medial side 105 corresponds with an inside area of the foot (i.e., the surface that faces toward the other foot). Forefoot region 101, midfoot region 102, heel region 103, lateral side 104, and medial side 105 are not intended to demarcate precise areas of footwear 100. Rather, forefoot region 101, midfoot region 102, heel region 103, lateral side 104, and medial side 105 are intended to represent general areas of footwear 100 to aid in the following discussion. In addition to footwear 100, forefoot region 101, midfoot region 102, heel region 103, lateral side 104, and medial side 105 may also be applied to sole structure 110, upper 120, and individual elements thereof.

Sole structure 110 is secured to upper 120 and extends between the foot and the ground when footwear 100 is worn. The primary elements of sole structure 110 are a midsole 111, an outsole 112, and a sockliner 113. Midsole 111 is secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 111 may incorporate plates, moderators, fluid-filled chambers, lasting elements, or motion control members that further attenuate forces, enhance stability, or influence the motions of the foot, or midsole 111 may be primarily formed from a fluid-filled chamber. Outsole 112 is secured to a lower surface of midsole 111 and may be formed from a wear-resistant rubber material that is textured to impart traction. Sockliner 113 is located within upper 120 and is positioned to extend under a lower surface of the foot to enhance the comfort of footwear 100. Although this configuration for sole structure 110 provides an example of a sole structure that may be used in connection with upper 120, a variety of other conventional or nonconventional configurations for sole structure 110 may also be utilized. Accordingly, the features of sole structure 110 or any sole structure utilized with upper 120 may vary considerably.

Upper 120 defines a void within footwear 100 for receiving and securing a foot relative to sole structure 110. The void is shaped to accommodate the foot and extends along a lateral side of the foot, along a medial side of the foot, over the foot, around the heel, and under the foot. Access to the void is provided by an ankle opening 121 located in at least heel region 103. In some embodiments of the disclosure, lace 122 may extend through various lace apertures 123 in upper 120 and permits the wearer to modify dimensions of upper 120 to accommodate proportions of the foot. More particularly, lace 122, if present, permits the wearer to tighten upper 120 around the foot, and lace 122 permits the wearer to loosen upper 120 to facilitate entry and removal of the foot from the void (i.e., through ankle opening 121). Collar 143 extends around ankle opening 121. In addition, upper 120 may include a tongue 124 that extends under lace 122 and lace apertures 123 to enhance the comfort of footwear 100. In further configurations, upper 120 may include additional elements, such as (a) a heel counter in heel region 103 that enhances stability, (b) a toe guard in forefoot region 101 that is formed of a wear-resistant material, and (c) logos, trademarks, and placards with care instructions and material information.

Many conventional footwear uppers are formed from multiple material elements (e.g., textiles, polymer foam, polymer sheets, leather, and synthetic leather) that are joined through stitching or bonding, for example. In contrast, in embodiments of the disclosure, a majority of upper 120 is formed from a knitted component 130, which extends through each of forefoot region 101, midfoot region 102, and heel region 103 along both lateral side 104 and medial side 105, over forefoot region 101, and around heel region 103. In addition, knitted component 130 forms portions of both an exterior surface and an opposite interior surface of upper 120. As such, knitted component 130 defines at least a portion of the void within upper 120. In some configurations, knitted component 130 may also extend under the foot.

Figure 4:
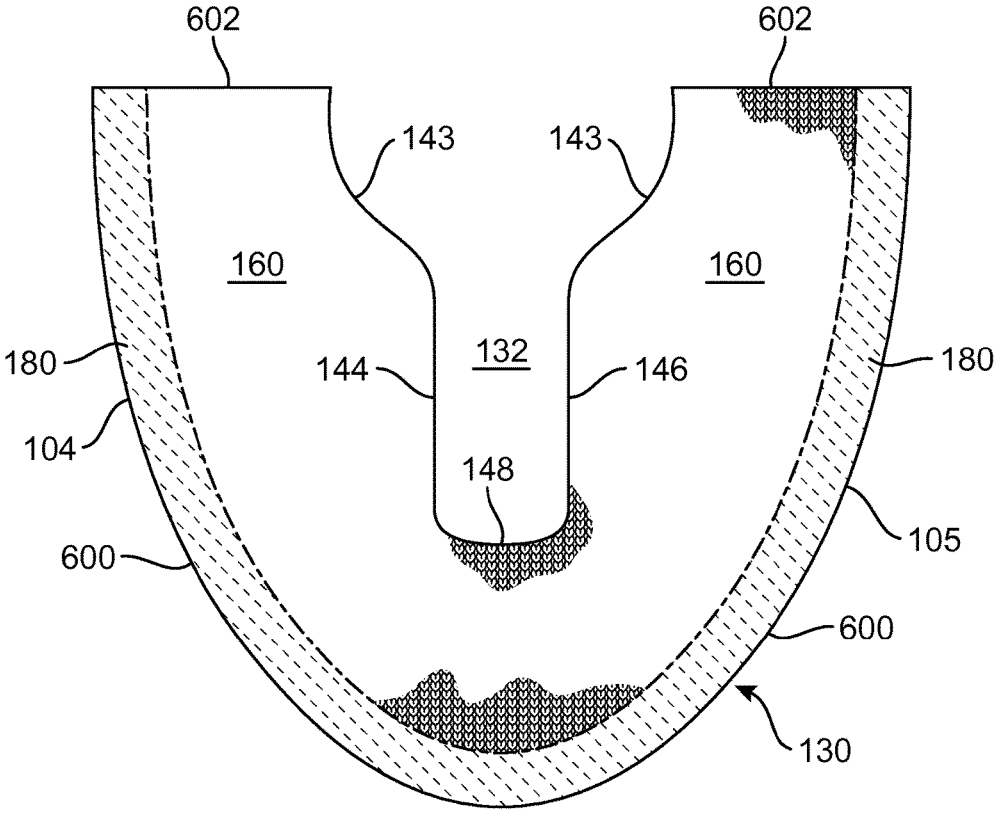
FIG. 4 is a top plan view of an exemplary embodiment of a knitted component with an area of first yarn and an area of second yarn.

FIG. 4, FIG. 5, FIG. 6, FIG. 7, and FIG. 8 illustrate an exemplary embodiment wherein knitted component 130 is adapted to be attached to a strobel sock. In FIG. 4, knitted component 130 is shown in a planar or flat configuration. In this embodiment, knitted component 130 has a generally U-shaped configuration that is outlined by an outer perimeter edge 600. In this embodiment, outer perimeter edge 600 extends around knitted component 130 from lateral side 104 to medial side 105. The outer perimeter of knitted component 130 also includes a pair of heel edges 602 disposed on each of lateral side 104 and medial side 105. In an exemplary embodiment, knitted component 130 may further include an inner perimeter that will be associated with and define instep area 132. In this embodiment, the inner perimeter of knitted component 130 includes lateral inner perimeter edge 144 and medial inner perimeter edge 146. Lateral inner perimeter edge 144 and medial inner perimeter edge 146 are disposed on opposite sides of knitted component 130. Lateral inner perimeter edge 144 and medial inner perimeter edge 146 are spaced apart and define instep area 132 of upper 120. Additionally, the inner perimeter further includes forward edge 148. In embodiments where article 100 includes tongue 124 that extends through instep area 132, tongue 124 maybe joined or attached to upper 120 at forward edge 148 of knitted component 130.

In various embodiments, knitted component 130 may incorporate various types of yarn that impart different properties to separate areas of upper 120. For example, one area or portion of knitted component 130 may be formed from a first type of yarn that imparts a first set of properties, and another area or portion of first knitted component 130 may be formed from a second type of yarn that imparts a second set of properties. In this configuration, properties may vary throughout upper 120 by selecting specific yarns for different areas of knitted component 130. In an exemplary embodiment, knitted component 130 includes a first portion 160 comprising a first yarn and a second portion 180 comprising a second yarn different from the first yarn. As described below, knitted component 130 may be formed of unitary knit construction such that each of the areas of knitted component 130, including first portion 160 and second portion 180, are knitted as a one-piece element.

Knitted component 130 can be formed of unitary knit construction. As used herein, the term "unitary knit construction" means that the respective component is formed as a one-piece element through a knitting process. That is, the knitting process substantially forms the various features and structures of unitary knit construction without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided. Examples of various configurations of knitted components and methods for forming knitted component 130 with unitary knit construction are disclosed in U.S. Pat. No. 6,931,762 to Dua; U.S. Pat. No. 7,347,011 to Dua, et al.; U.S. Patent Application Publication 2008/0110048 to Dua, et al.; U.S. Patent Application Publication 2010/0154256 to Dua; and U.S. Patent Application Publication 2012/0233882 to Huffa, et al.; each of which is incorporated herein by reference in its entirety. Knitted component 130 remains formed of unitary knit construction when other elements, such as a lace, lace apertures, logos, trademarks, placards with care instructions or other information, such as material information and size, tensile or structural elements, are added following the knitting procedure.

Figure 5:
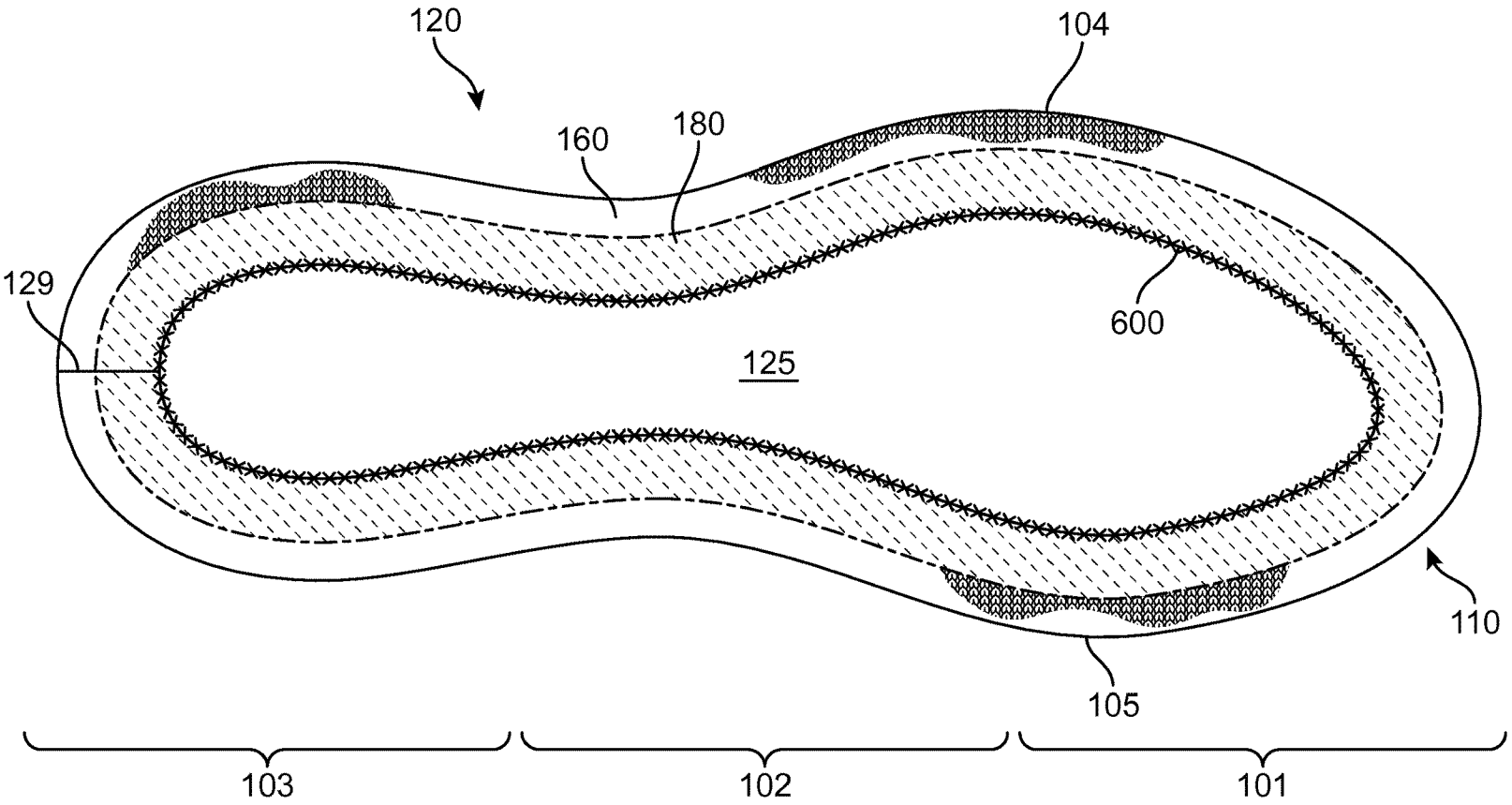
FIG. 5 is a bottom view of an exemplary embodiment of an upper of the article of footwear attached to a strobel.

In some embodiments, knitted component 130 may be joined to strobel sock 125 for attachment to sole structure 110, as illustrated in FIG. 5. Strobel sock 125 may be stitched to outer perimeter edge 600 of second portion 180 of knitted component 130. In addition, heel edges 602 are joined to each other and extend vertically in heel region 103 of article 100 to form seam 129. In some embodiments of an article of footwear, a material element may cover seam 129 between heel edges 602 to reinforce seam 129 and enhance the aesthetic appeal of the article.

Figure 6:
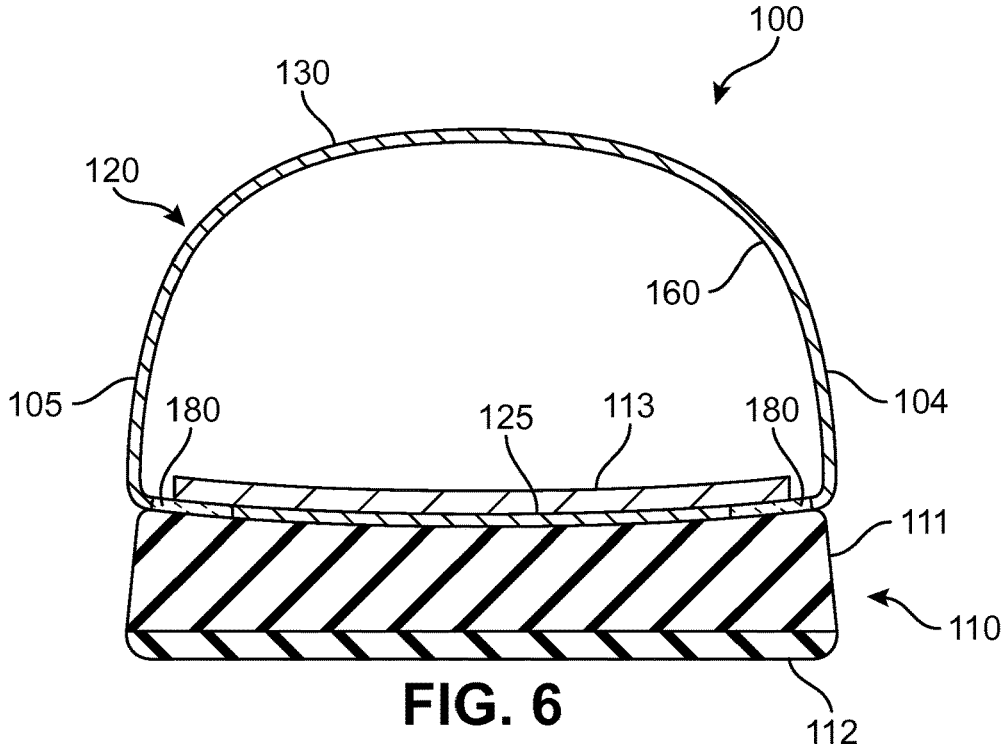
FIG. 6 is a cross-sectional view of an exemplary embodiment of the article of footwear defined by section lines 6 in FIG. 2 and FIG. 3.
Figure 7:
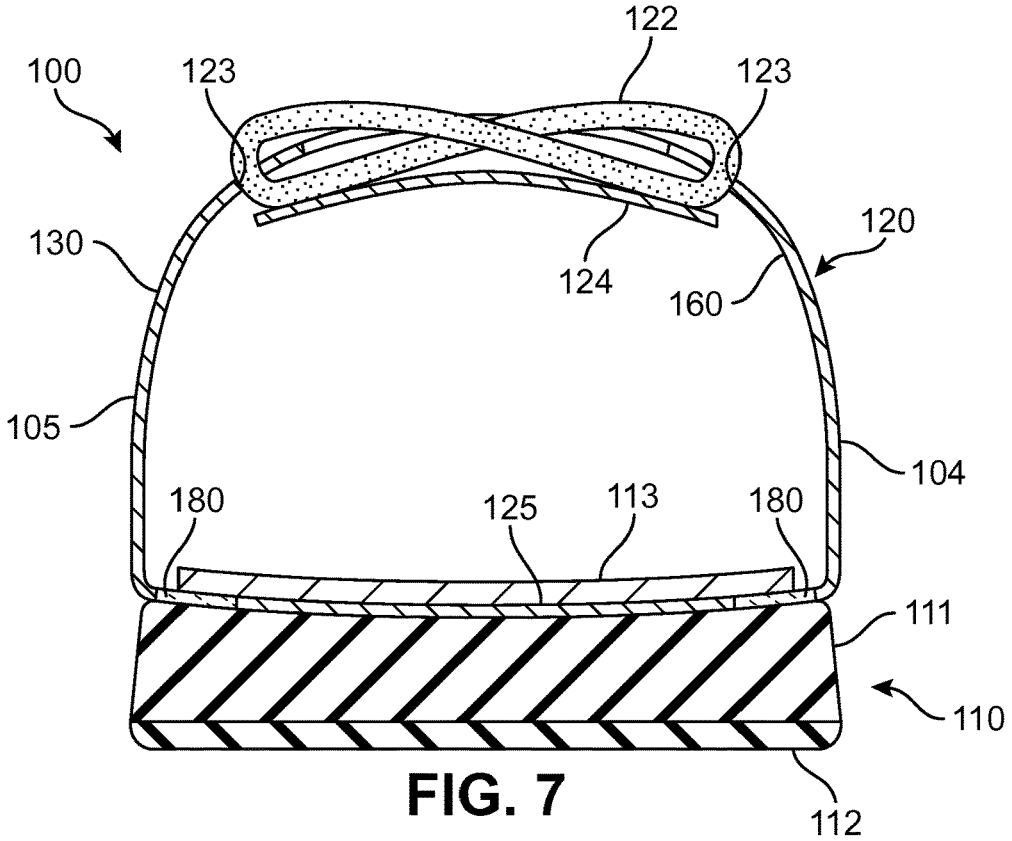
FIG. 7 is a cross-sectional view of an exemplary embodiment of the article of footwear defined by section lines 7 in FIG. 2 and FIG. 3.
Figure 8:
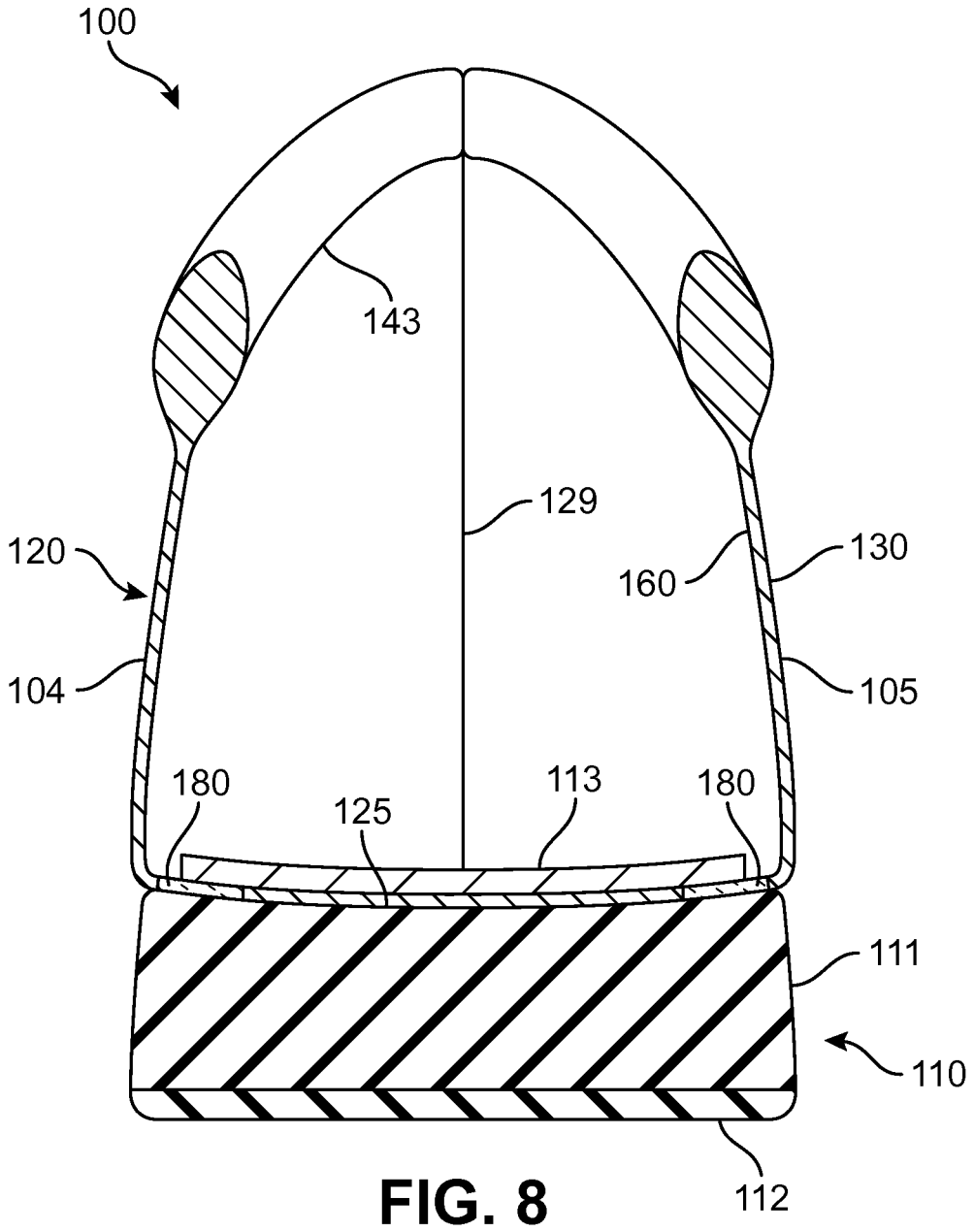
FIG. 8 is a cross-sectional view of an exemplary embodiment of an article of footwear defined by section lines 8 in FIG. 2 and FIG. 3.

Referring now to FIG. 6, FIG. 7, and FIG. 8, knitted component 130 is incorporated into upper 120 of article of footwear 100. As illustrated, first portion 160 of knitted component 130 extends from lateral side 104 to medial side 105 of upper 120. Second portion 180 of knitted component 130 is secured to strobel sock 125, forming a portion of upper 120 that extends under a portion of sockliner 113. FIG. 7 also illustrates lace 122 and tongue 124, which may be present on upper 120. Lace 122, if present, may pass through lace apertures 123.

Knitted component 130 may include instep area 132 of upper 120. In some embodiments, instep area 132 may include a plurality of lace apertures 123 disposed in knitted component 130. Lace apertures 123, if present, may extend through knitted component 130 and may be configured to receive a lace, including lace 122. In an exemplary embodiment, lace apertures 123 may be formed directly into knitted component 130 by knitting. In other embodiments, however, lace apertures 123 may include additional reinforcing elements added to knitted component 130. In other embodiments, knitted component 130 may not include lace 122 or lace apertures 123.

In some embodiments, a strobel sock is not used. Rather, second portion 180 is formed so that outer perimeter edge 600 may be joined under sockliner 113. In such embodiments, second portion 180 of knitted component 130 is wider than the corresponding portion for use with a strobel because the stitched-together second portion 180 essentially spans the width of the article of footwear.

Figure 9:
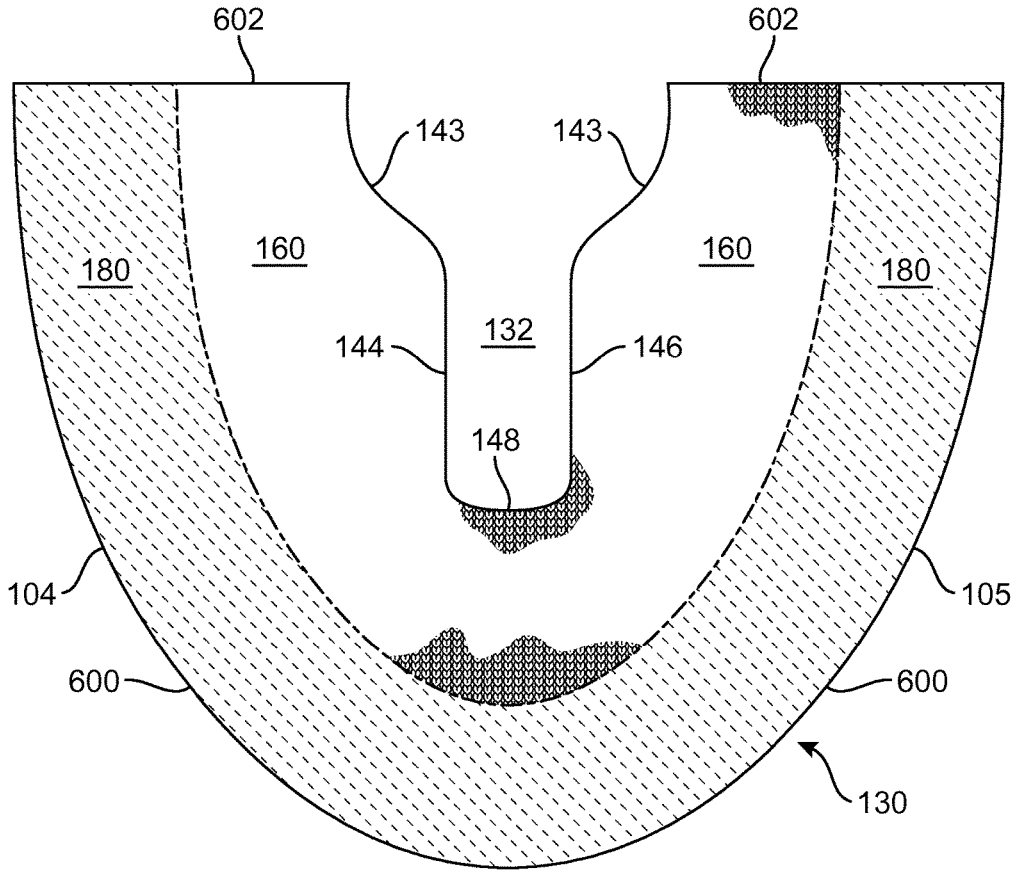
FIG. 9 is a top plan view of another exemplary embodiment of a knitted component with an area of first yarn and an area of second yarn.

FIG. 9 illustrates such an embodiment of the disclosure. Second portion 180 is wider than second portion 180 of FIG. 4, and is adjacent first portion 160. The dimensions of second portion 180 are established so that outer perimeter edge 600 on lateral side 104 can be stitched to or otherwise attached to outer perimeter edge 600 on medial side 105 to form a void for the wearer's foot when knitted component 130 is associated with sole structure 110 to form article of footwear 100.

Figure 10:
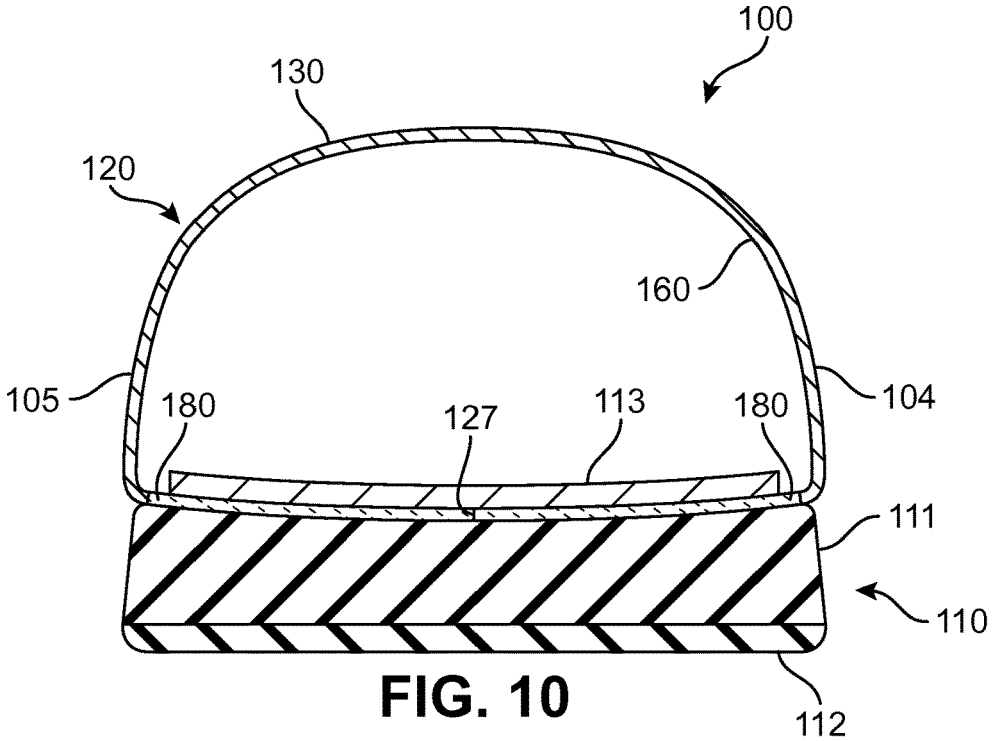
FIG. 10 is a cross-sectional view of another exemplary embodiment of the article of footwear defined by section lines 6 in FIG. 2 and FIG. 3.
Figure 11:
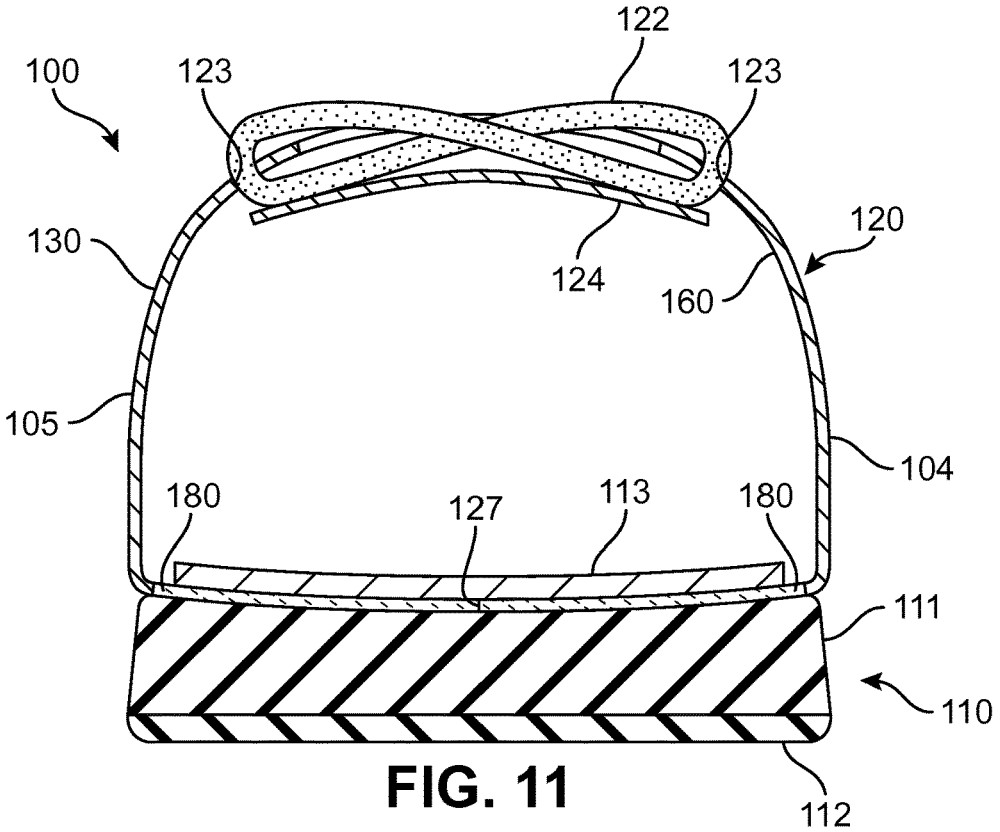
FIG. 11 is a cross-sectional view of another exemplary embodiment of the article of footwear defined by section lines 7 in FIG. 2 and FIG. 3.
Figure 12:
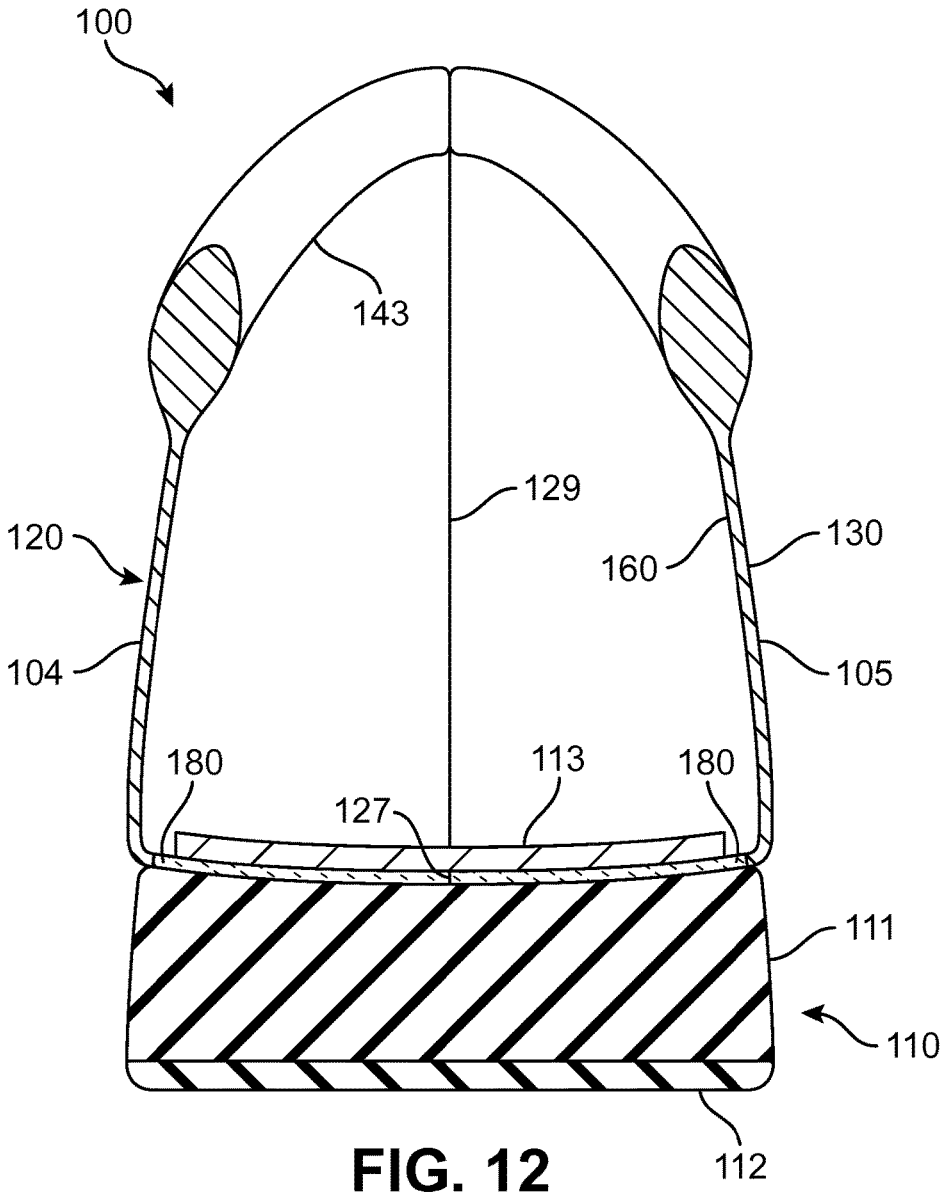
FIG. 12 is a cross-sectional view of another exemplary embodiment of an article of footwear defined by section lines 8 in FIG. 2 and FIG. 3.

Turning now to FIG. 10, FIG. 11, and FIG. 12, the lateral side of second portion 180 may be stitched to or otherwise attached to the medial side of second portion 180, essentially spanning the width of the article of footwear 100, to form a void for the wearer's foot, as illustrated in FIG. 10, FIG. 11, and FIG. 12. In some embodiments, the width of second portion 180 on lateral side 104 may be essentially equal to the width of second portion on medial side 105.

In some embodiments, seam 127 resulting from the stitching or joining together of the sides of second portion 180 may be located essentially on the longitudinal midline of article of footwear 100 if the size of second portion 180 is essentially the same on each side of article of footwear 100. In other embodiments of the disclosure, the seam may be located anywhere under sockliner 113. Such an adjustment can be made by making one side of second portion 180 wider than the other.

Figure 13:
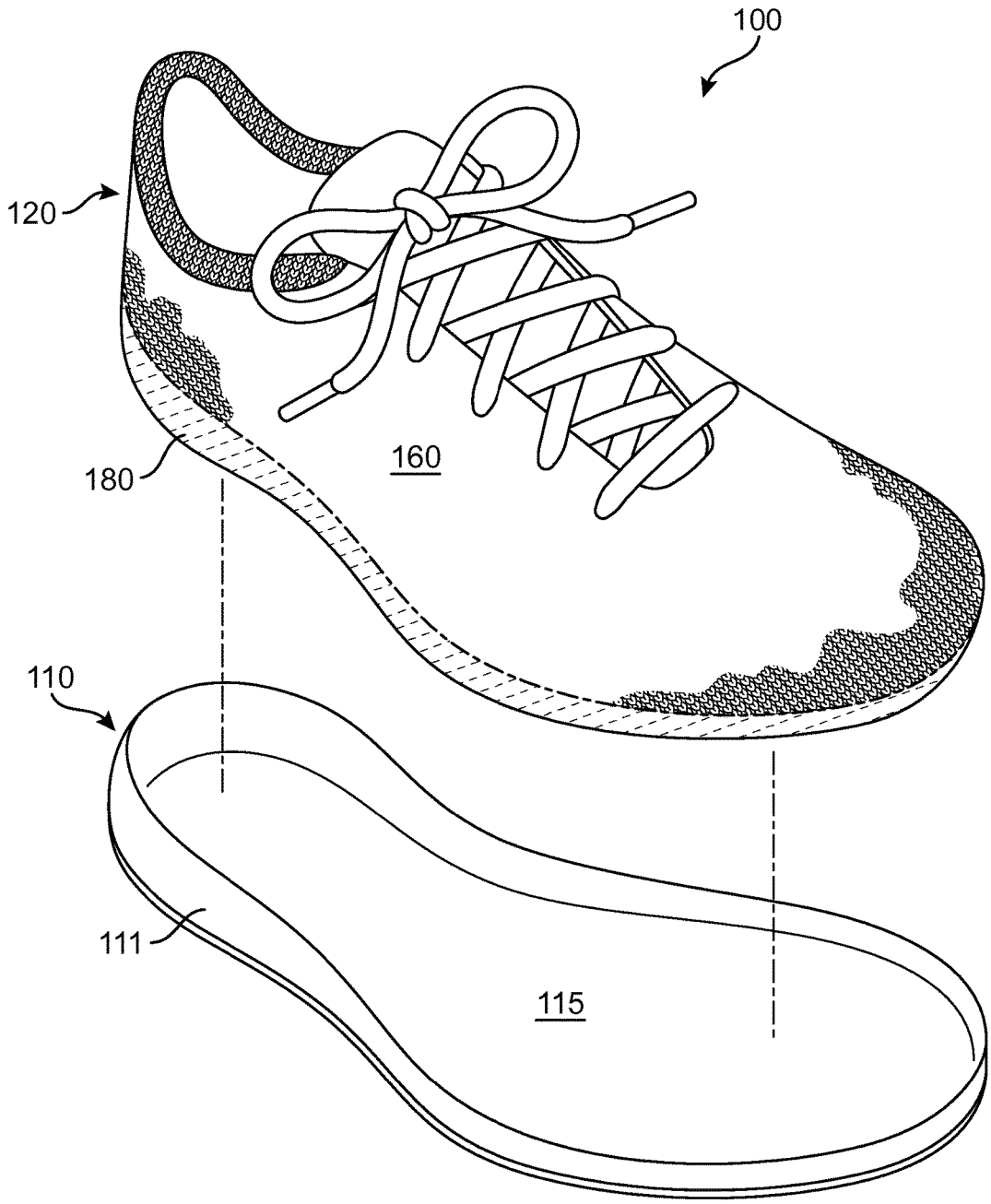
FIG. 13 is an exploded schematic view of an embodiment of an exemplary article of footwear.

The relationship between upper 120 and sole structure 110 is illustrated in FIG. 13. In some embodiments, upper 120 of article of footwear 100 may be sewn along outer perimeter edges 600 on the lateral side and medial side of second portion 180. In other embodiments, strobel sock 125 may be sewn to outer perimeter edge 600 of second portion 180. Upper 120 and upper surface 115 of midsole 111 are attached to each other, typically by adhesive bonding.

Figure 14:
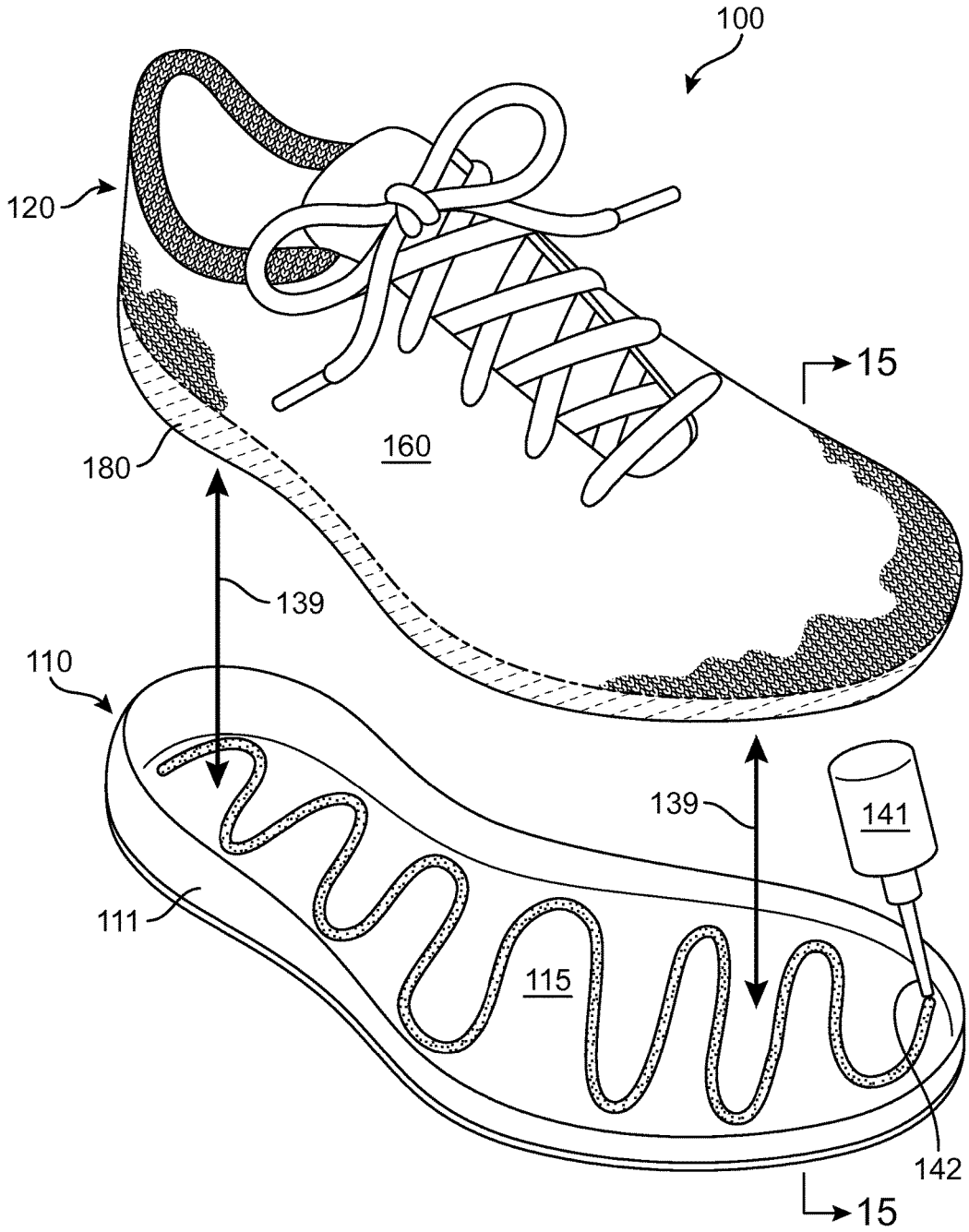
FIG. 14 is a schematic view of an exemplary method of manufacturing an article of footwear.

An exemplary embodiment of a method disclosed herein is illustrated in FIG. 14. In some embodiments, upper 120 is prepared for attachment to surface 115 of midsole 111 in sole structure 110 by putting a strobel sock in place between outer perimeter edges 600 of second portion 180. In other embodiments, upper 120 is prepared by mating one side of outer perimeter edge 600 of upper 120 to the opposite side outer perimeter edge 600 to form a surface for attachment to surface 115 of midsole 111.

In some embodiments, the location of the portion of knitted component 130 that is associated with sole structure 110 when upper 120 is attached to the sole structure 110 to form article of footwear 100 may be referred to as the "bite line". In an exemplary embodiment, the bite line may extend a small distance in the vertical direction upwards along upper 120 around the perimeter of article of footwear 100. In some cases, the bite line may include a visual indication on knitted component 130 to facilitate alignment and joining of upper 120 with sole structure 110. In other cases, however, the bite line may not be visually indicated on knitted component 130. In one embodiment, the bite line of knitted component 130 may correspond with the location and arrangement of second portion 180 on knitted component 130. With this configuration, the properties of second portion 180 may facilitate the attachment of sole structure 110 to upper 120.

Referring again to the exemplary method of FIG. 14, in a next step, adhesive then may be applied to one or both of the surfaces to be adhered. Adhesive may be applied in any manner, such as by brushing, wiping, direct application from a nozzle or spray head. In one embodiment, adhesive 140 may be applied to surface 115, for example from container 141 through nozzle 142. In some cases, adhesive 140 may additionally be applied or extend to the sides or lip of sole structure 110 that are raised above surface 115. Then, upper 120 and sole structure 110 are moved together, as illustrated by movement arrows 139, and are pressed together for a time sufficient to bond upper 120 to sole structure 110. Adhesive 140 may cure after an initial bond is formed.

Figure 15:
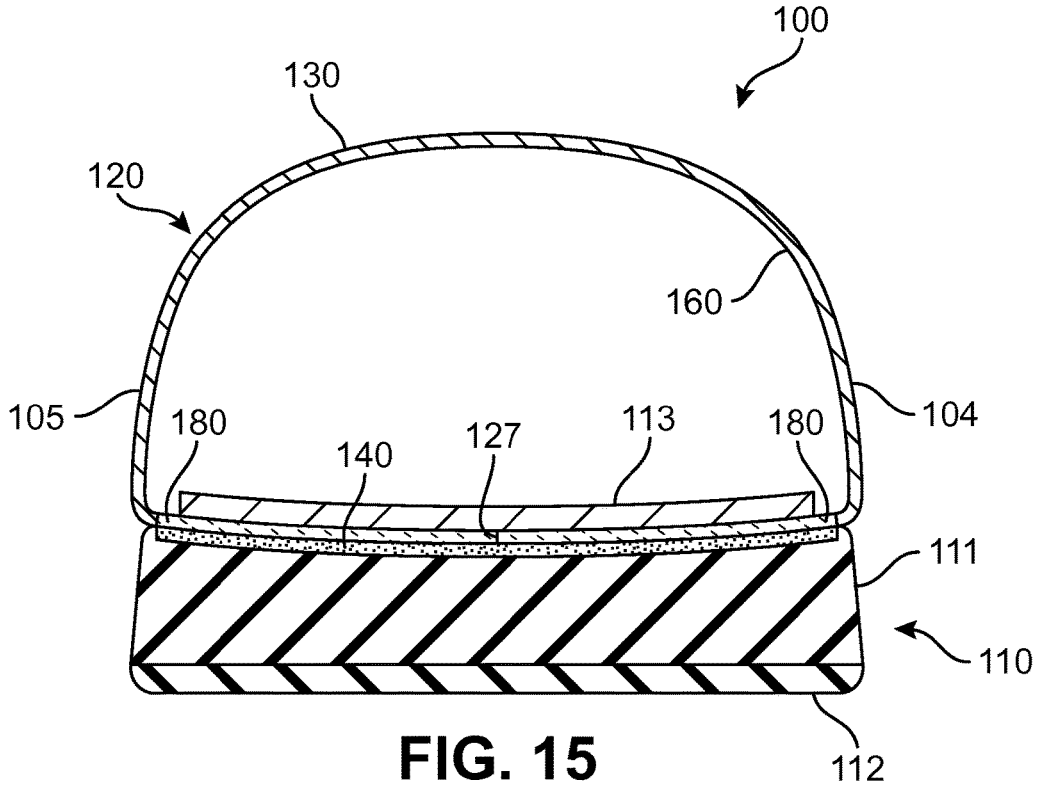
FIG. 15 is a magnified cross-sectional view along section line 15 on FIG. 14.

As can be seen in FIG. 15, which is a magnified cross-sectional view taken at section line 15 at FIG. 14, adhesive 140 covers the entirety or a substantial majority of the bottom of second portion 180 and surface 115 of midsole 111. Adhesive 140 thus forms a layer between the bottom of second portion 180 and midsole surface 115, as can be seen in the magnified cross-sectional view.

Figure 16:
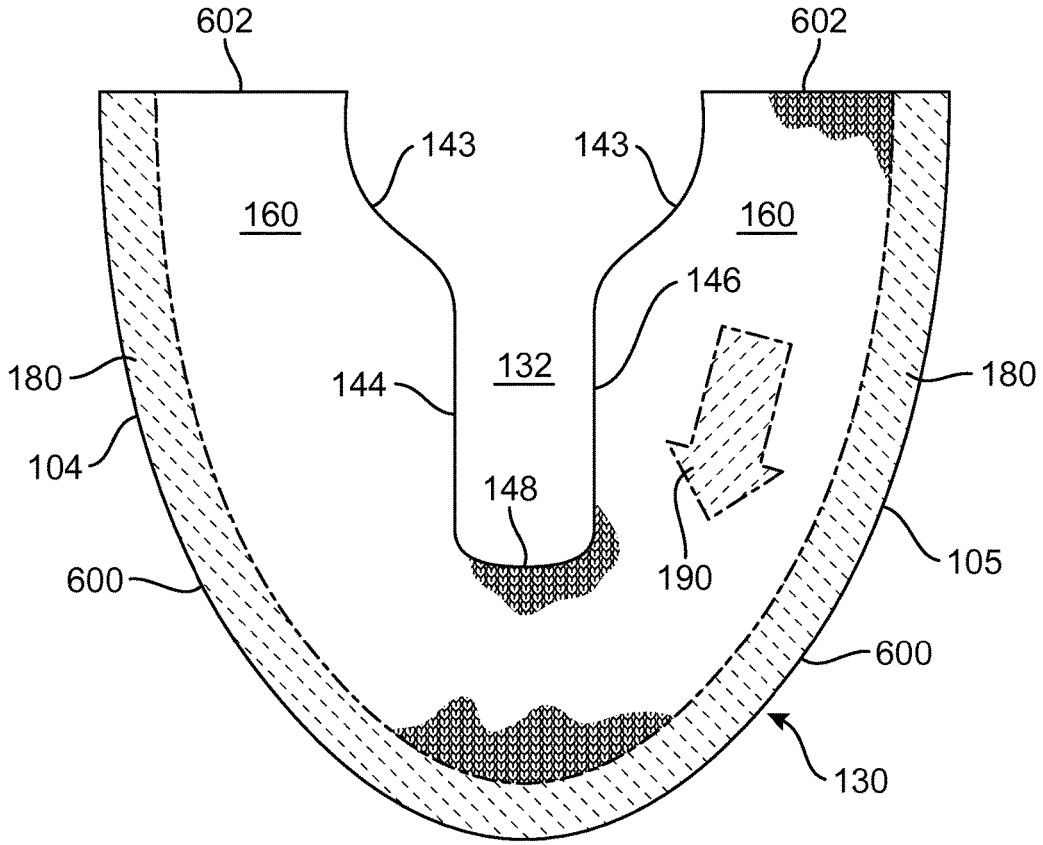
FIG. 16 is a top plan view of an exemplary embodiment of a knitted component with an area of first yarn and areas of second yarn.

In some embodiments, a third portion having yarn that does not have durable water repellence may be included within the first portion. Such a third portion may, for example be useful as an area to which a water-based materials may be applied to form an indicium such as a word, a symbol, as shape, or a design. In FIG. 16, third portion 190 is illustrated as an arrow on medial side 105. However, third portion 190 may take any shape or shapes, and may be formed anywhere on upper 120. For example, third portion 190 may be located in an area where a structural or other feature, such as a toe cap or a heel counter, may be adhered to upper 120 with a water-based adhesive. Third portion 190 may be formed by any yarn that will form an appropriate substrate for the water-based material forming the indicium. For example, in some embodiments, the yarn used to form second portion 180 may be suitable. In other embodiments, the yarn used to form third portion 190 may be the same type as the yarn used to form second portion 180, but may have a different color.

In some embodiments, a fourth portion having yarn that has durable water repellant properties may be included in a rand, an area vertically above the biteline on the outside of the upper of an article of footwear. In some embodiments, both a third portion and a fourth portion may be present.

In some embodiments, upper 120 may include any number of tensile strands or tensile elements inlaid or placed along any suitable area of upper 120 without departing from the scope of the present disclosure. Moreover, tensile strands suitable for use with upper 120 may include the tensile strands and/or tensile elements and the method of manufacturing a knitted component incorporating tensile strands or tensile elements disclosed in one or more of commonly-owned U.S. application Ser. No. 13/048,540 to Huffa et al., entitled "Method Of Manufacturing A Knitted Component", filed on Mar. 15, 2011 and published as United States Patent Application Publication No 2012/0234052 on Sep. 20, 2012; U.S. patent application Ser. No. 12/338,726 to Qua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, all of which applications are hereby incorporated by reference in their entireties.

Various methods, machines, and tools can be used for forming, treating, and otherwise adjusting knitted component 130 and for forming article of footwear 100 from upper 120 incorporating knitted component 130. It will be appreciated that the order of steps within the method may vary from the order described herein. Certain steps or aspects of some steps may be skipped or eliminated as well. Moreover, two or more steps within the method may be carried out sequentially or simultaneously. Furthermore, the steps within the method may be carried out manually or automatically, using any suitable tool, machine, or implement.

Generally, in exemplary embodiments of the method, a knitting process is used to form a knitted component 130, such as knitted component 130 shown in FIG. 4, FIG. 9, and FIG. 16. Then, knitted component 130 can be further processed and adjusted, for example, by securing knitted component 130 to a workpiece, adjusting tensile strands, if appropriate, and steaming. Additional steps of the method depend upon whether a strobel is to be used. If a strobel is present, the next method step may be to attach the strobel to the knitted component, as illustrated in FIG. 5. Then, strobel 125 and sole structure 110 may be attached, such as by adhesion, to finish construction of article of footwear 100. If no strobel is present, the outer perimeter edge and at least a portion of the heel edges may be arranged to form an upper having a bottom. Then, sole structure 110 is attached to upper 120.

In some embodiments, a knitted component for use with article of footwear 100 may be steamed during manufacture. Steaming of knitted component 130 may assist with setting and arranging the individual yarns of knitted component 130 into an orderly configuration. A durable water repellence-providing composition also may be provided before or during steaming. FIG. 17, FIG. 18, FIG. 19, and FIG. 20 illustrate embodiments by which durable water repellence-providing compositions can be applied.

Figure 17:
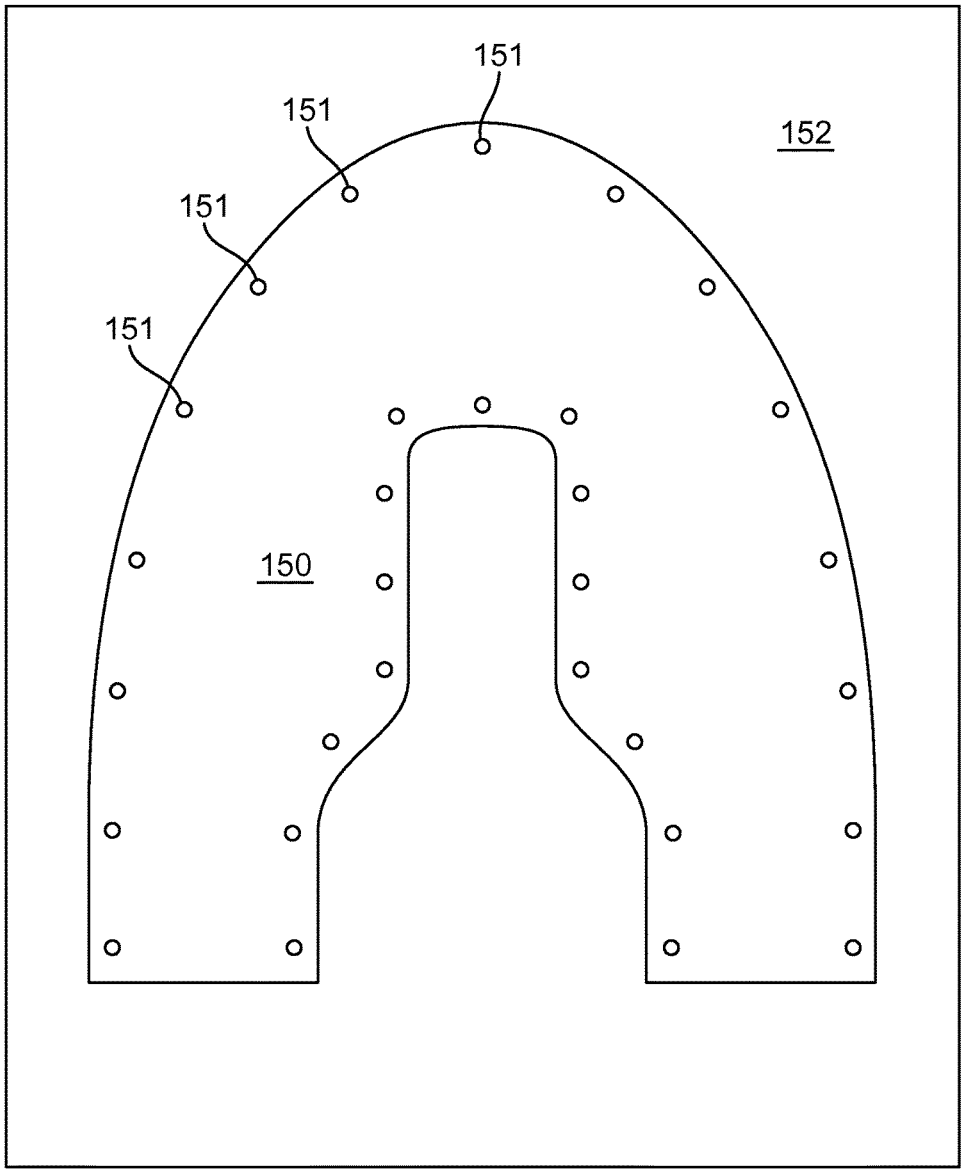
FIG. 17 is a top plan view of a knitted component on a holder.
Figure 18:
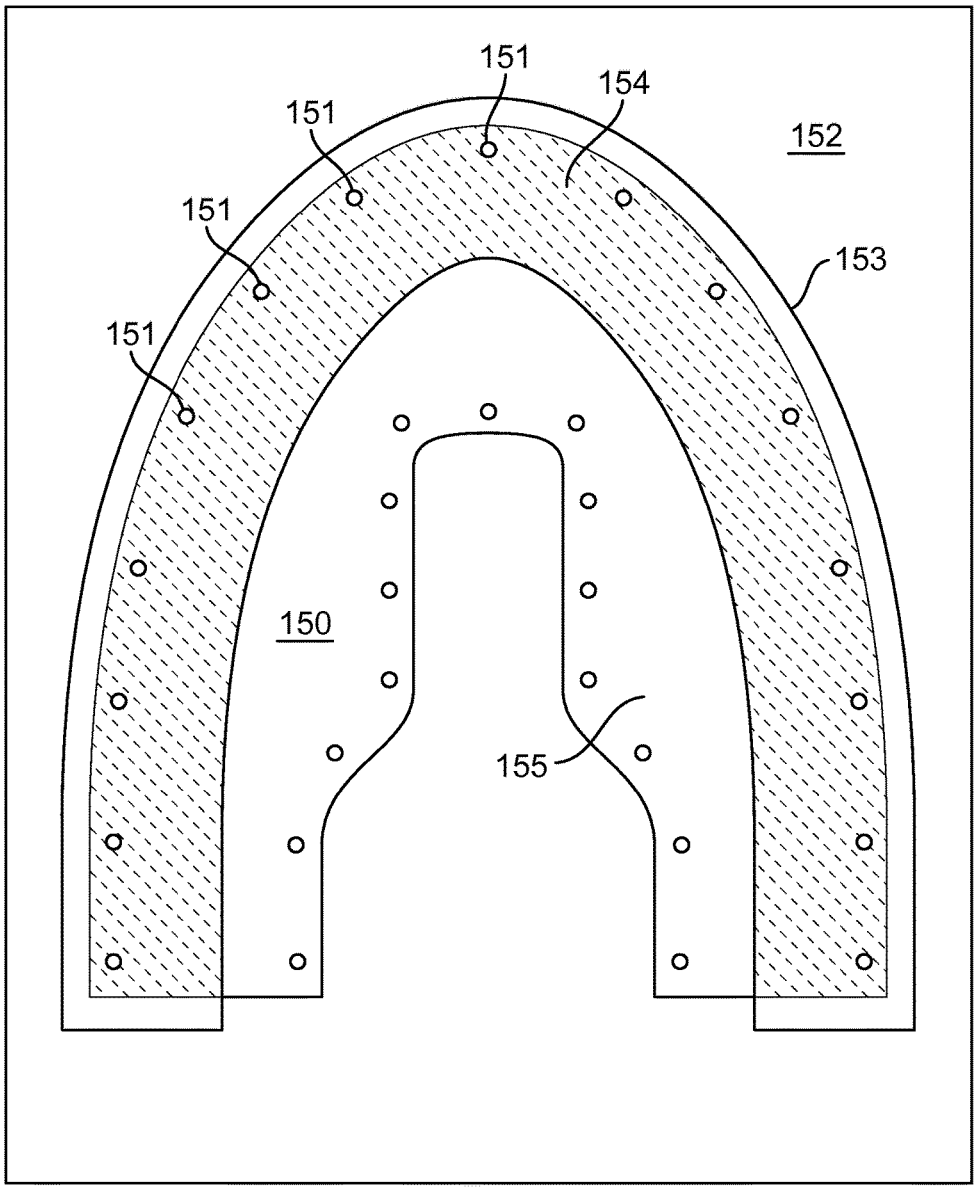
FIG. 18 is a top plan view of a knitted component on a holder under a removable mask.

FIG. 17 and FIG. 18 illustrate knitted component 150 held in place by retainers 151 on holder 152. In an exemplary embodiment, knitted component 150 may differ from knitted component 130, described above. In this embodiment, knitted component 150 is knitted of yarn that does not have significant durable water repellant properties. As shown in FIG. 18, a removable mask 153 may be placed over knitted component 150 to cover selected portions of knitted component 150 to preclude deposition of durable water repellence-providing composition. In an exemplary embodiment, removable mask 153 may be placed on knitted component 150 so as to cover second portion 154 of knitted component 150. Accordingly, as shown in FIG. 18, second portion 154 of knitted component 150 is disposed under removable mask 153. Thus, durable water repellence-providing composition supplied to knitted component 150 will be deposited only on first portion 155, leaving second portion 154 essentially untreated and, like second portion 180, suitable for use with water-based adhesive. In some embodiments, removable mask 153 also may be shaped to protect a third portion 190 within first portion 155 to form an area that can accept water-based indicia, as described above with regard to FIG. 16.

Figure 19:
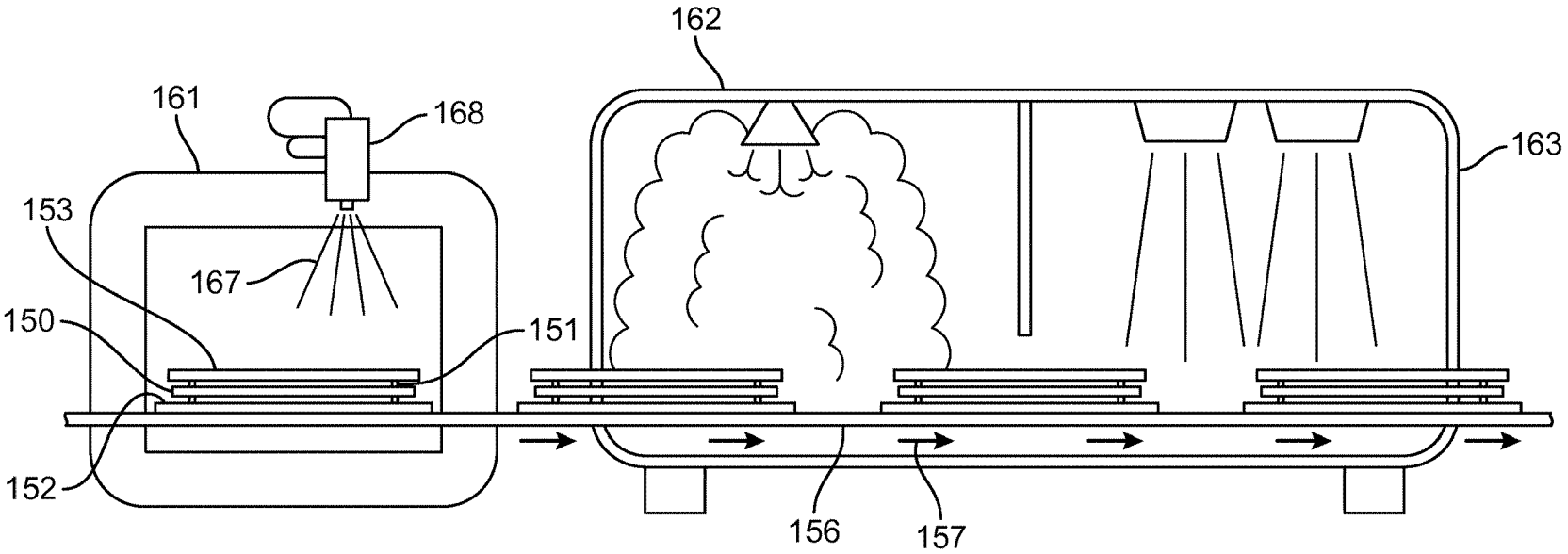
FIG. 19 is a schematic diagram of an embodiment of a process for applying durable water repellence-providing composition.
Figure 20:
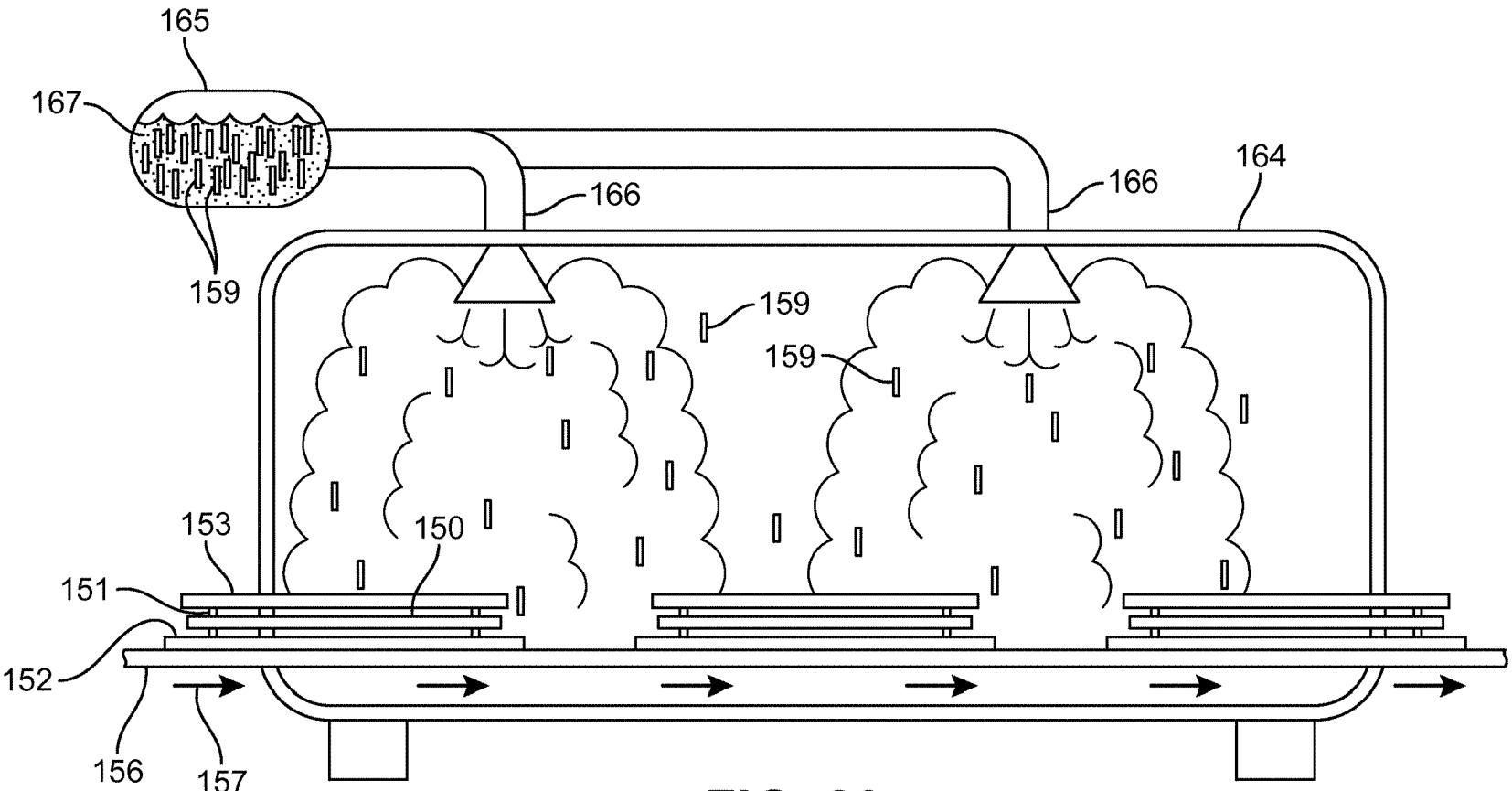
FIG. 20 is a schematic diagram of an embodiment of a process for applying durable water repellence-providing composition.

FIG. 19 and FIG. 20 illustrate schematically embodiments of methods of applying durable water repellant-providing composition after knitted component 150 has been knitted. FIG. 19 illustrates an embodiment including holders 152, including retainers 151, on which knitted component 150 and removable mask 153 may be retained. Holders 152 may be mounted on continuous belt 156 or other device for movement in the direction of arrows 157 sequentially through first chamber 161, second chamber 162, and third chamber 163. In first chamber 161, sprayer 168 may introduce durable water repellence-providing composition 167 on first portion 155 of knitted component 150, and removable mask 153 may preclude durable water repellence-providing composition 167 from depositing on second portion 154. Holder 152 and its contents then may be moved into second chamber 162, where knitted component 150 may be steamed, and then may be moved to third chamber 163, where knitted component 150 may be dried. Holder 152 and its contents then may be removed from third chamber 163 for further processing. In this method, illustrated in FIG. 19, the steam in second chamber 162 aids durable water repellence-providing composition 167 to penetrate the yarn in first portion 155 of knitted component 150.

Embodiments of the method illustrated in FIG. 20 involve application of durable water repellence-providing composition in steam chamber 164. FIG. 20 illustrates holders 152, including retainers 151, on which knitted component 150 and removable mask 153 may be retained. Holders 152 may be mounted on continuous belt 156 or other device for movement in the direction of arrows 157 to chamber 164. Tank 165 holds an aqueous mixture 167 containing durable water repellence-providing composition 159. The mixture may be transported through conduits 166 and the aqueous fraction may be vaporized in chamber 164. Durable water repellence-providing composition 159, shown as black rectangles for convenience, may be introduced with the steam caused by vaporization of the water in mixture 167 in chamber 164. The steam in chamber 164 aids penetration of durable water repellence-providing composition 167 into the yarn in first portion 155 of knitted component 150.

In some embodiments, these methods also may be used to mask an area to form a third portion within the first portion to form a third portion that is not treated with durable water repellence-providing composition. Water-based indicia may be applied to this third portion. Removable mask 153 may be used to cover the third portion.

Figure 21:
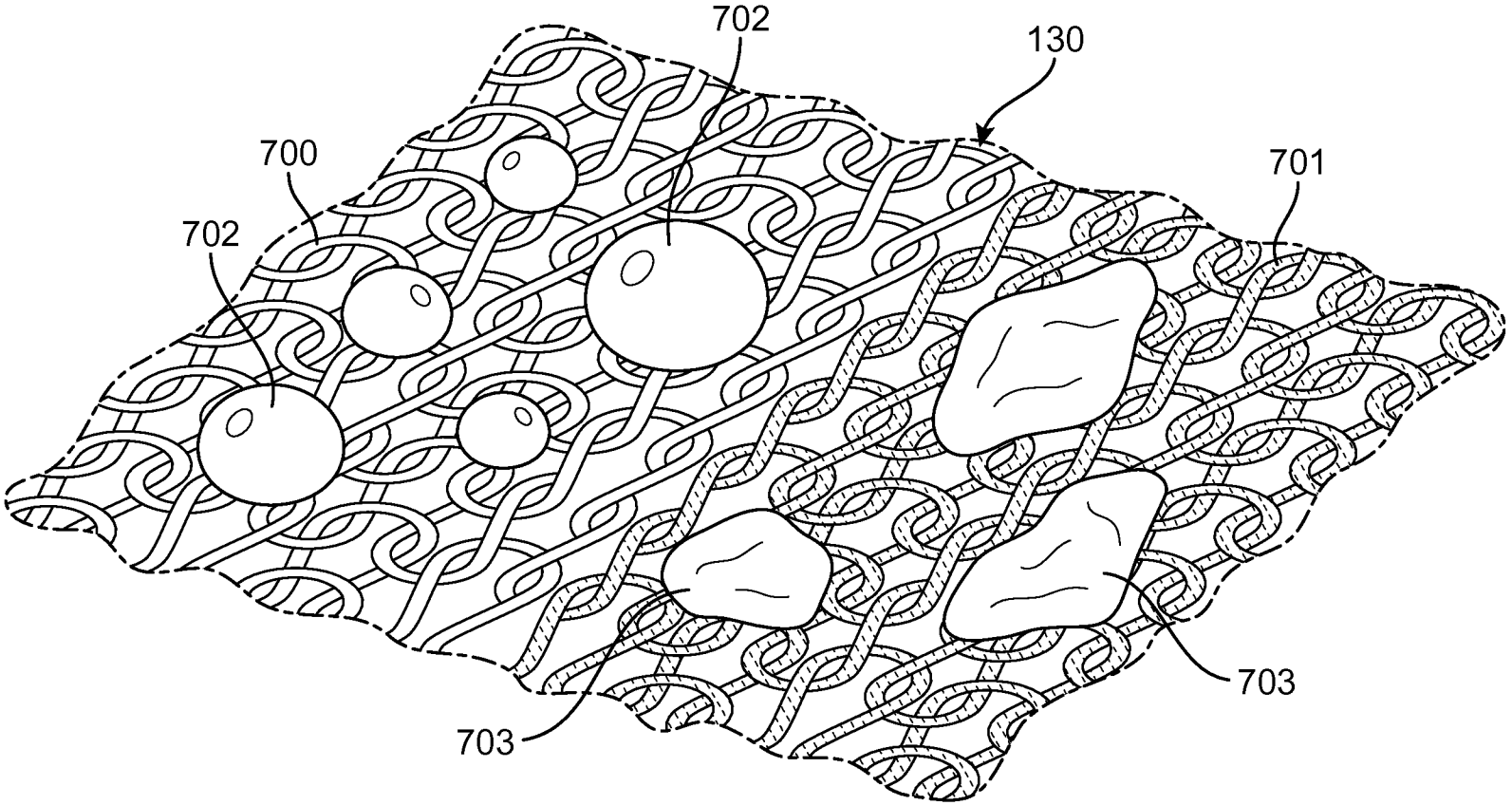
FIG. 21 is an orthographic view of the behavior of water on untreated yarn and on yarn treated with durable water repellant material.

Durable water repellence-providing compositions on yarn will cause water to be repelled, whereas water will not be repelled from the same yarn devoid of durable water repellence-providing material. Knitted component 130 is illustrated with two types of yarn in FIG. 21. Water forms beads 702 on yarn 700. As can be seen, the contact angle, i.e., the angle formed between the water drop and the surface of knitted component 130, is at least about 90°. In contrast, water spreads and forms puddles 703 rather than drops on untreated yarn 701. The contact angle of puddles 703 on untreated yarn 701 is less than about 90°, and typically may be less than or equal to about 45°. Low contact angles, i.e., angles less than about 90°, allow water-based adhesive to bind with untreated yarn 701 of knitted component 130 for attaching elements, such as sole structure 110 or other components, to knitted component 130.

Knitting Process

Figure 22:
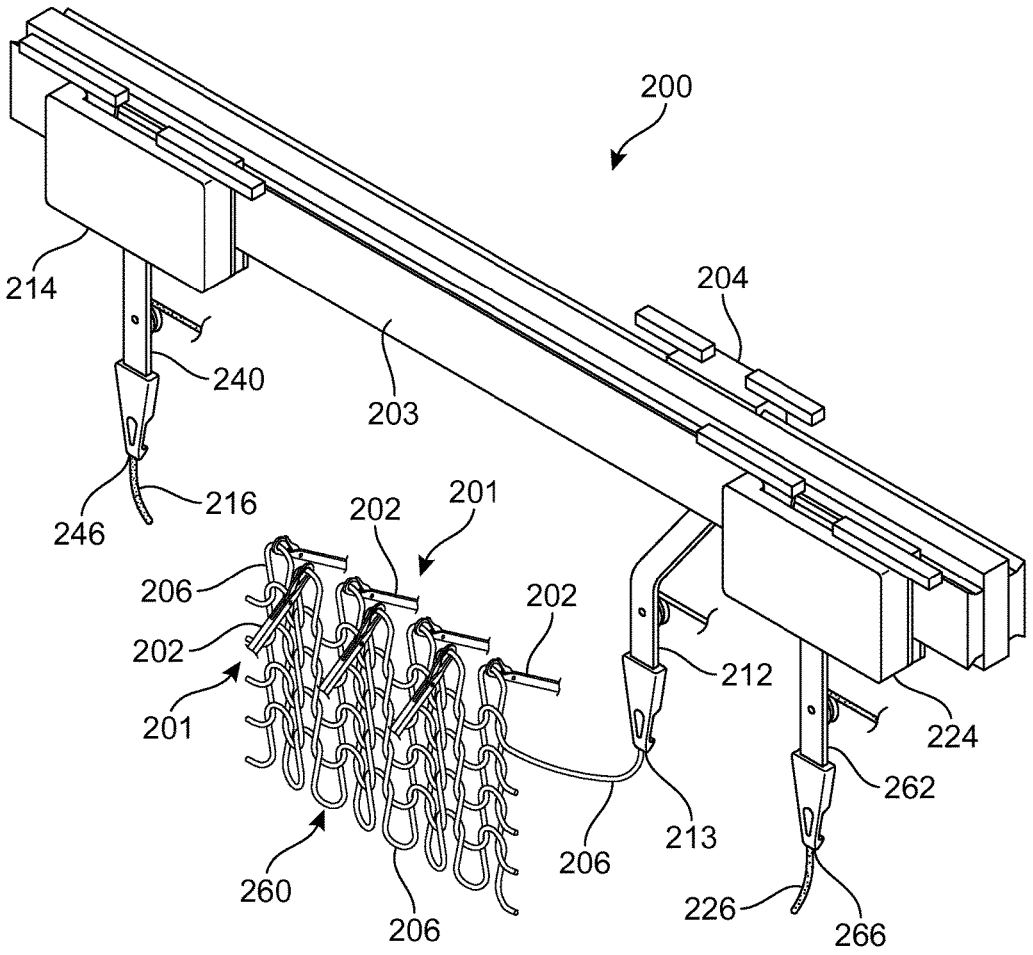
FIG. 22 is a schematic perspective view of a knitting process using conventional feeders.
Figure 23:
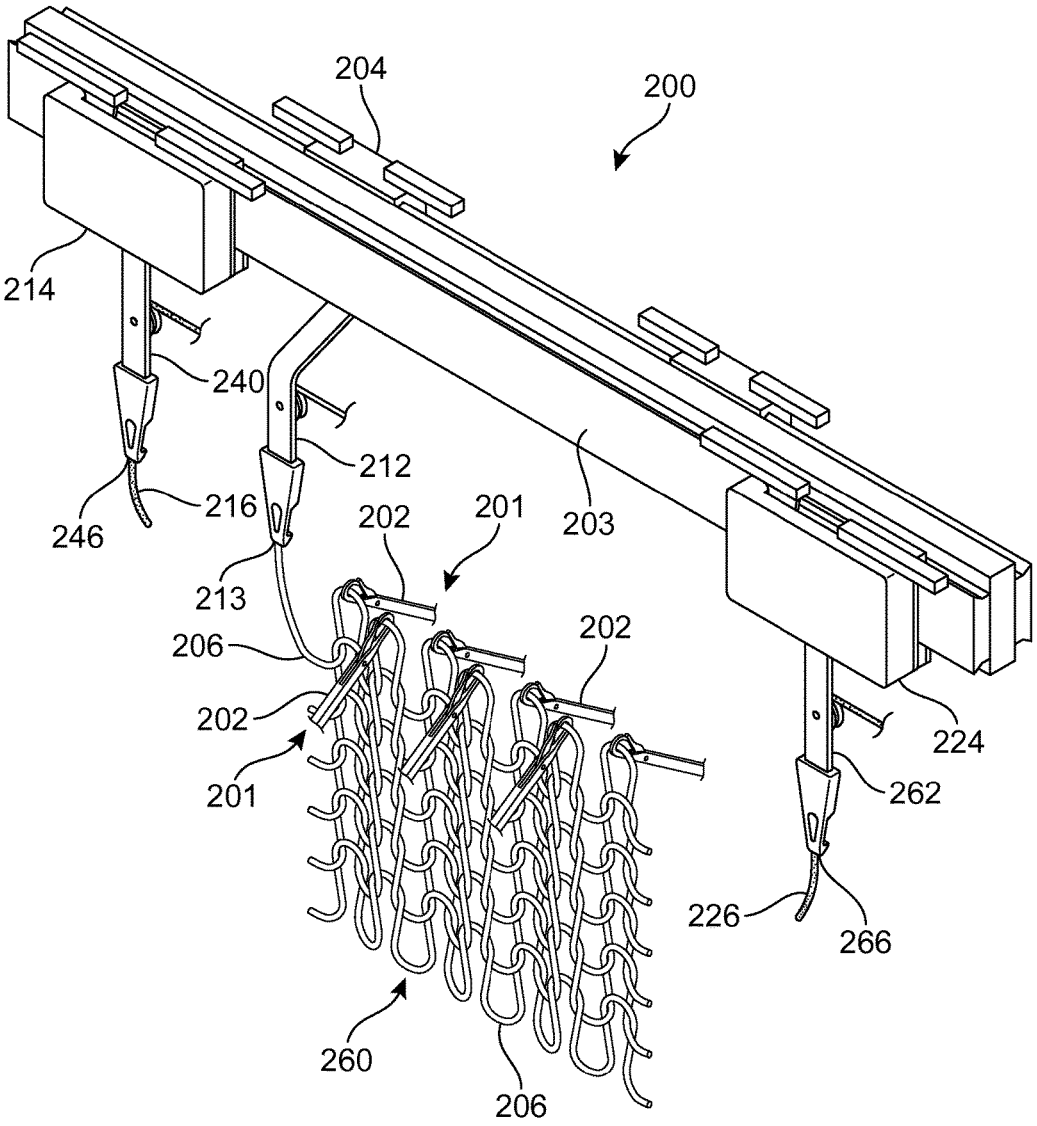
FIG. 23 is a schematic perspective view of a knitting process using conventional feeders.
Figure 24:
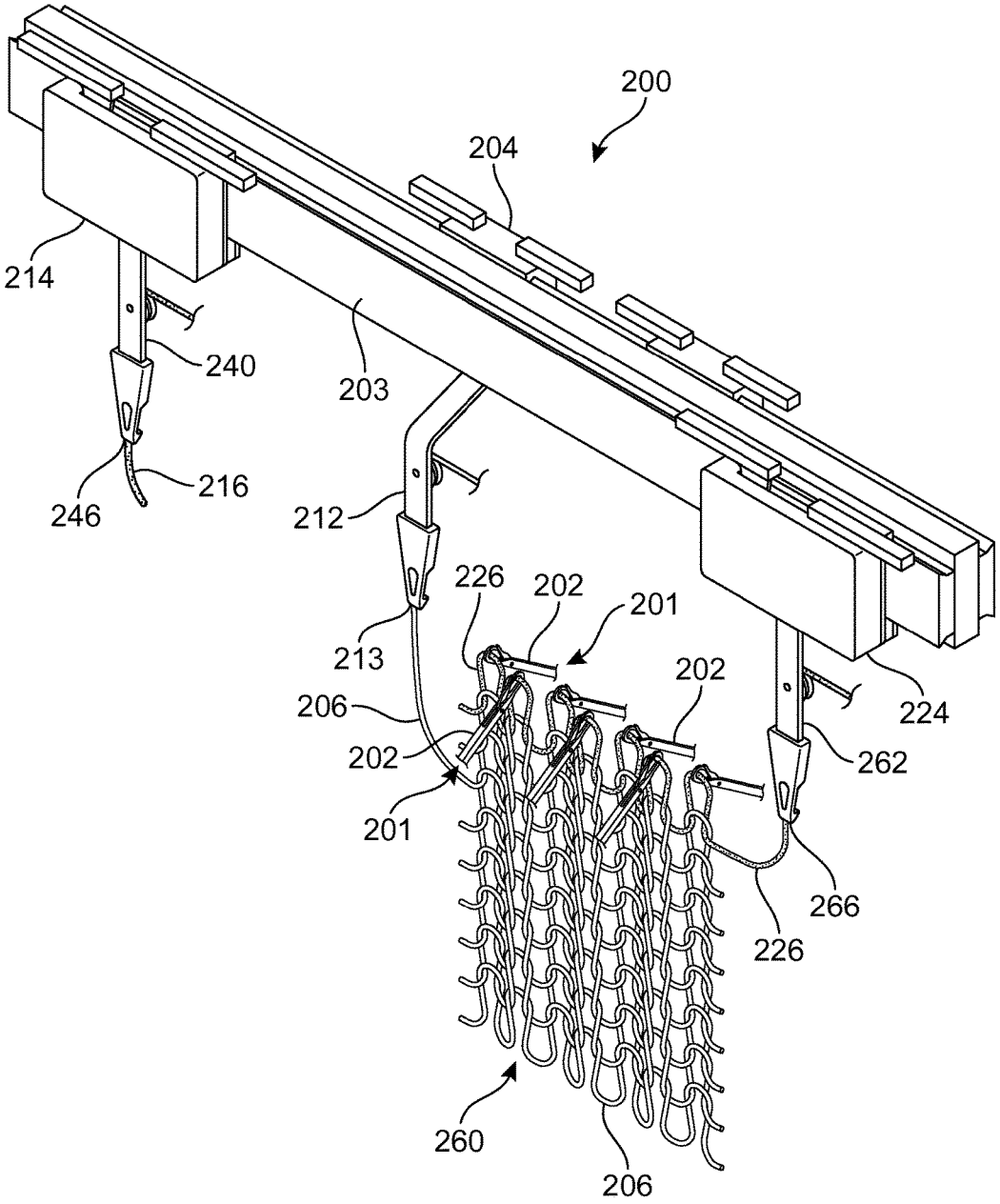
FIG. 24 is a schematic perspective view of a knitting process using conventional feeders showing introduction of the second yarn.

FIG. 22, FIG. 23, and FIG. 24 illustrate an exemplary process of knitting a knitted component, including a knitted component substantially similar to knitted component 130 described above. Referring to FIG. 22, a portion of knitting machine 200 that includes needles 202 and rail 203 is shown. Additionally, in this embodiment of the disclosure, knitting machine 200 may include first standard feeder 204, second standard feeder 214, and third standard feeder 224 that are substantially similar to each other. In addition, in embodiments of the disclosure wherein knitted component 130 includes tensile elements, a combination feeder (not shown) may be included to form a tensile element during the process of knitting knitted component 260. For the purposes of ease of illustration, therefore, knitted component 260 will be illustrated in FIG. 22 through FIG. 24 without a tensile element.

Referring again to FIG. 22, first standard feeder 204 may be secured to a rear side of rail 203, and second standard feeder 214 and third standard feeder 224 may be secured to a front side of rail 203. In other embodiments of the disclosure, additional feeders may be used and may be located on the front or rear side of rail 203.

In this embodiment, first yarn 206 from a spool (not shown) passes through first standard feeder 204 and an end of yarn 206 extends outwardly from first dispensing tip 213 at the end of first feeder arm 212. Although yarn 206 is depicted, any other strand (e.g., a filament, thread, rope, webbing, cable, chain, or yarn) may pass through first standard feeder 204. Second yarn 216 similarly passes through second standard feeder 214 and extends outwardly from second dispensing tip 246 on second feeder arm 240. Third yarn 226 may pass in a similar manner through third standard feeder 224 to third dispensing tip 266 on third feeder arm 262.

In an exemplary embodiment, second yarn 216 or third yarn 226 may be a different type of yarn than first yarn 206. In such an embodiment of the disclosure, first yarn 206 may be a yarn that has water-repellent properties, and second yarn 216 and third yarn 226 may not be water repellent. In an exemplary embodiment, second yarn 216 and third yarn 226 may be used to form lateral portions, medial portions, and other edge portions, generally described as second portion herein, and other portions, of a knit element forming knitted component 130, whereas first yarn 206 may be used to form the first portion of knitted component 130. In other embodiments of the disclosure, however, second yarn 216 and third yarn 226 may be different and may be used to form other portions of the knit element forming knitted component 130.

The knitting process discussed herein relates to the formation of a knitted component 260, which may be any knitted component, including knitted components that are similar to knitted component 130. For purposes of the discussion, only a relatively small section of knitted component 260 is shown in the Figures in order to permit the knit structure to be illustrated. Moreover, the scale or proportions of the various elements of knitting machine 200 and knitted component 260 may be enhanced to better illustrate the knitting process.

First standard feeder 204 includes first feeder arm 212 with first dispensing tip 213. First feeder arm 212 is angled to position first dispensing tip 213 in a location that is (a) centered between needles 202 and (b) above an intersection of needle beds 201. Note that needles 202 lay on different planes, which planes are angled relative to each other. That is, needles 202 from needle beds 201 lay on the different planes. Needles 202 each have a first position in which needles 202 are retracted, and a second position, in which needles 202 are extended. In the first position, needles 202 are spaced from the intersection where the planes upon which needle beds 201 lay meet. In the second position, however, needles 202 are extended and pass through the intersection where the planes upon which needle beds 201 meet. That is, needles 202 cross each other when extended to the second position. It should be noted that first dispensing tip 213 second dispensing tip 246, and third dispensing tip 266, are located above the intersection of the planes. In this position, first dispensing tip 213, second dispensing tip 246, and third dispensing tip 266, supply yarn to needles 202 for purposes of knitting, tucking, and floating.

Referring now to FIG. 23, first standard feeder 204 moves along rail 203 and a new course is formed in knitted component 260 from yarn 206. More particularly, needles 202 pulls sections of yarn 206 through the loops of the prior course, thereby forming the new course. Accordingly, courses may be added to knitted component 260 by moving standard feeder 204 along needles 202, thereby permitting needles 202 to manipulate yarn 206 and form additional loops from yarn 206.

Referring now to FIG. 24, an exemplary embodiment, with loops of first yarn 206 form a portion of knitted component 260, is illustrated. However, the top row of yarn is third yarn 226 from third standard feeder 224. As can be seen, third standard feeder 224 moved along rail 203 to supply third yarn 226 to form the row. In another exemplary embodiment, with third standard feeder 224 positioned at the far right of rail 203, second standard feeder 214 may be used to form the top row using second yarn 216.

In the exemplary knitting process depicted in FIG. 22 through FIG. 24, the relative positions of the various feeders on rail 203 may restrict the portions of knitted component 260 that may be formed by each respective feeder. For example, second standard feeder 214 and third standard feeder 224 cannot pass by each other of rail 203 to form portions of knitted component 260. Each of second standard feeder 214 and third standard feeder 224 can traverse the entire length of rail 203. Thus, only one standard feeder need be used to supply a type of yarn different from yarn 206, and either second standard feeder 214 or third standard feeder 224 may suitably be used. Thus, knitted component 260 having only two types of yarn may be formed using only two of the standard feeders. However, a third type of yarn, for example, a yarn of a different type or color from the other two yarns, may be supplied by third standard feeder 224.

The processes and methods for knitting a knitted component described and illustrated herein are exemplary and are not meant to be exhaustive. Therefore, it should be understood that additional knitted components including the features of the embodiments described herein, as well as similar knitted components including the features of the embodiments described herein, as well as similar knitted components not explicitly described herein, may be made using one or more knitting processes substantially similar to the knitting method for knitted components described herein or in the documents incorporated by reference.

Figure 25:
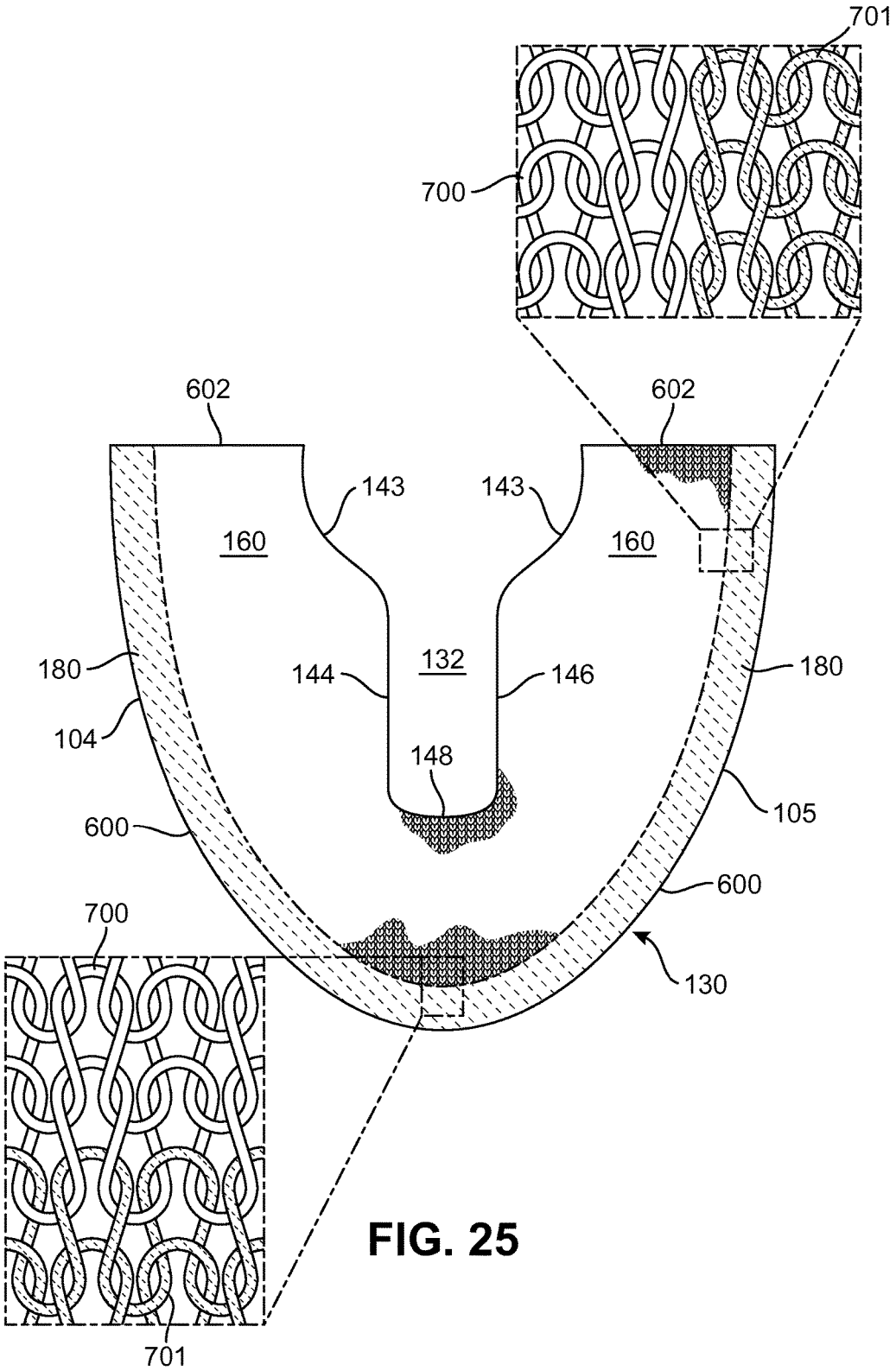
FIG. 25 is a top plan view of an exemplary embodiment of the knitted component with areas of first yarn and areas of second yarn, including enlarged views of exemplary knit structure.

Referring now to FIG. 25, enlarged views of parts of two boundary zones between first portion 160 and second portion 180 are illustrated to show the unitary knit construction of knitted component 130. A boundary zone on knitted component 130 defines the region of knitted component 130 where the yarn used to knit knitted component 130 transitions from one yarn type to another yarn type. For example, knitted component 130 may transition from a first type of yarn 700 forming first portion 160 to a second type of yarn 701 forming second portion 180 at a boundary zone on upper 120. In an exemplary embodiment, first type of yarn 700 transitions from a yarn having durable water repellant properties to second yarn 701 different from yarn 700 at a boundary zone associated with each first portion 160 and second portion 180.

As shown in FIG. 25, at forward forefoot boundary 209 in forefoot region 101 of knitted component 130, knitted component 130 transitions from first portion 160 formed by first yarn having durable water repellant properties 700 to the remaining portion of knitted component 130 formed by second type of yarn 701. In this embodiment, a course of first yarn 700 is joined (e.g., by interlooping) to an adjacent course of second type of yarn 701. That is, a course formed by knitting first yarn 700 is substantially continuous with a course formed by knitting second type of yarn 701. With this configuration, first portion 160 and second portion 180 may be formed of unitary knit construction with knitted component 130.

Similarly, adjacent wales of knitted component 130 may also transition from one type of yarn to a different type of yarn at boundary zones. As shown in FIG. 25, at top medial boundary 210, knitted component 130 transitions from a portion formed by first type of yarn 700 to second portion 180 formed by second yarn 701. In this embodiment, wales of first type of yarn 700 are joined to an adjacent wale of second type of yarn 701. In one embodiment, second portion 180 may be knit using an intarsia knitting technique to transition between yarn types along boundary zones. For example, wales of first type of yarn 700 may joined to adjacent wales of second type of yarn 701 by using intarsia knit construction techniques. With this configuration, first portion 160 and second portion 180 may be formed of unitary knit construction with knitted component 130. Intarsia techniques also are used to form areas such as third portion 190 illustrated in FIG. 16. The first portion, second portion, and third portion may be formed of unitary knit construction with knitted component 130.

Knitted component 130 can be formed from at least one yarn that is manipulated (e.g., with a knitting machine) to form a plurality of intermeshed loops that define a knitted component 130 having a variety of courses and wales. Thus, adjacent areas of knitted component 130 can share at least one common course or at least one common wale. That is, knitted component 130 can have the structure of a knit textile. It will be appreciated that knitted component 130 can be formed via weft knitting operations, warp knitting operations, flat knitting operations, circular knitting operations, or other suitable methods.

Knitted component 130 may incorporate various types and combinations of stitches and yarns. With regard to stitches, the yarn forming knitted component 130 may have one type of stitch in one area of knitted component 130 and another type of stitch in another area of knitted component 130. Depending upon the types and combinations of stitches utilized, areas of knitted component 130 may have a plain knit structure, a mesh knit structure, or a rib knit structure, for example. The different types of stitches may affect the physical properties of knitted component 130, including aesthetics, stretch, thickness, air permeability, and abrasion-resistance of knitted component 130. That is, the different types of stitches may impart different properties to different areas of knitted component 130. With regard to yarns, knitted component 130 may have one type of yarn in one area of knitted component 130 and another type of yarn in another area of knitted component 130.

The type of knit used to make the knitted component may affect water resistance of the upper. The ability of an article of footwear having an upper comprising a knitted component to prevent incursion of water through the upper may relate to the type and tightness of the knit. Tightness of the knit fabric may be expressed as the ratio of the fabric area covered by yarn to the whole area covered. Tighter knitted component will provide greater water resistance then a looser knitted component of the same knit style. Thus, in embodiments of the disclosure, tightness of the knit component is a consideration in establishing the water resistance of the article of footwear.

Woven Textile

The principles of the disclosure have been described above in detail relating to embodiments with respect to knitted components. These principles may be similarly applied to woven textile and woven components for incorporation into, for example, an article of footwear.

In one aspect, the disclosure provides a woven textile for an upper of an article of footwear. The woven textile includes a first portion formed by a first yarn, the first yarn having durable water repellent properties. The woven textile also has a second portion formed by a second yarn. The second yarn is different from the first yarn. The second yarn is disposed along an edge portion of the woven textile configured to be attached to the sole structure. The woven textile including the first portion and the second portion is formed of unitary woven construction.

In another aspect, the disclosure comprises an article of footwear having an upper and a sole structure secured to the upper. The upper comprises a woven textile formed of unitary woven construction. The woven textile comprises a first portion formed by a first yarn having durable water repellent properties. The woven textile has a second portion formed by a second yarn, the second yarn being different from the first yarn. The second yarn is disposed along an edge portion of the woven textile configured to be attached to the sole structure.

The disclosure provides a method of weaving a woven textile for an upper of an article of footwear having an upper and a sole structure. The method includes weaving a first portion of the woven textile formed by a first yarn, the first yarn having durable water repellent properties, and weaving a second portion of the woven textile formed by a second yarn, the second yarn being different from the first yarn. The second portion is disposed along an edge portion of the woven textile and is configured to be attached to the sole structure.

The disclosure also provides a method of manufacturing an article of footwear having an upper and a sole structure. The method comprises weaving a woven textile formed of a unitary woven construction for incorporation into the upper. A first portion of the woven textile is formed by first yarn, the first yarn having durable water repellent properties. A second portion of the woven textile disposed along an edge portion of the woven textile and configured to be attached to the sole structure is formed by a second yarn. The second yarn is different from the first yarn. The sole structure is attached to the second portion of the woven textile.

Woven textile may be described as including thread or yarn. For convenience, woven textile will be described in detail as constructed of yarn, but the disclosure encompasses the same manipulation techniques whether the material of construction is called thread or yarn.

A woven textile includes both warp (typically longitudinal) yarns and weft, or woof (typically transverse) yarns. Woof yarns are drawn through the warp yarns. Warp yarns often have a higher tensile strength than weft yarns have because warp yarn typically may be required to withstand stretching on a loom. Various woven patterns may be achieved by varying the number of warp yarns lifted in the path of a weft yarn as the shuttle crosses the loom, for example. Such patterns, including Jacquard, Dobby, twill, and denim, all are well-known to a skilled practitioner. Similarly, seersucker and other weaves that depend, in part, on differing tensions on the warp yarns, also are woven textiles.

Warp yarns may be the same as or different from weft yarns. Because both warp yarns and weft yarns are present on both faces, or sides, of the fabric, water may wick along or in a yarn from a wet side to a dry side of the fabric and thus pass from a 'wet' outside to a 'dry' inside and defeat the purpose of having durable water repellant materials present. Thus, in some embodiments, it may not be sufficient to use only one yarn having durable water repellant properties in an area intended to have durable water repellant properties. Therefore, in some embodiments, both warp yarn and weft yarn in a first portion of the woven textile, may have durable water repellant properties. Typically, both yarns in a first region have durable water repellant properties and characteristics.

Figure 31:
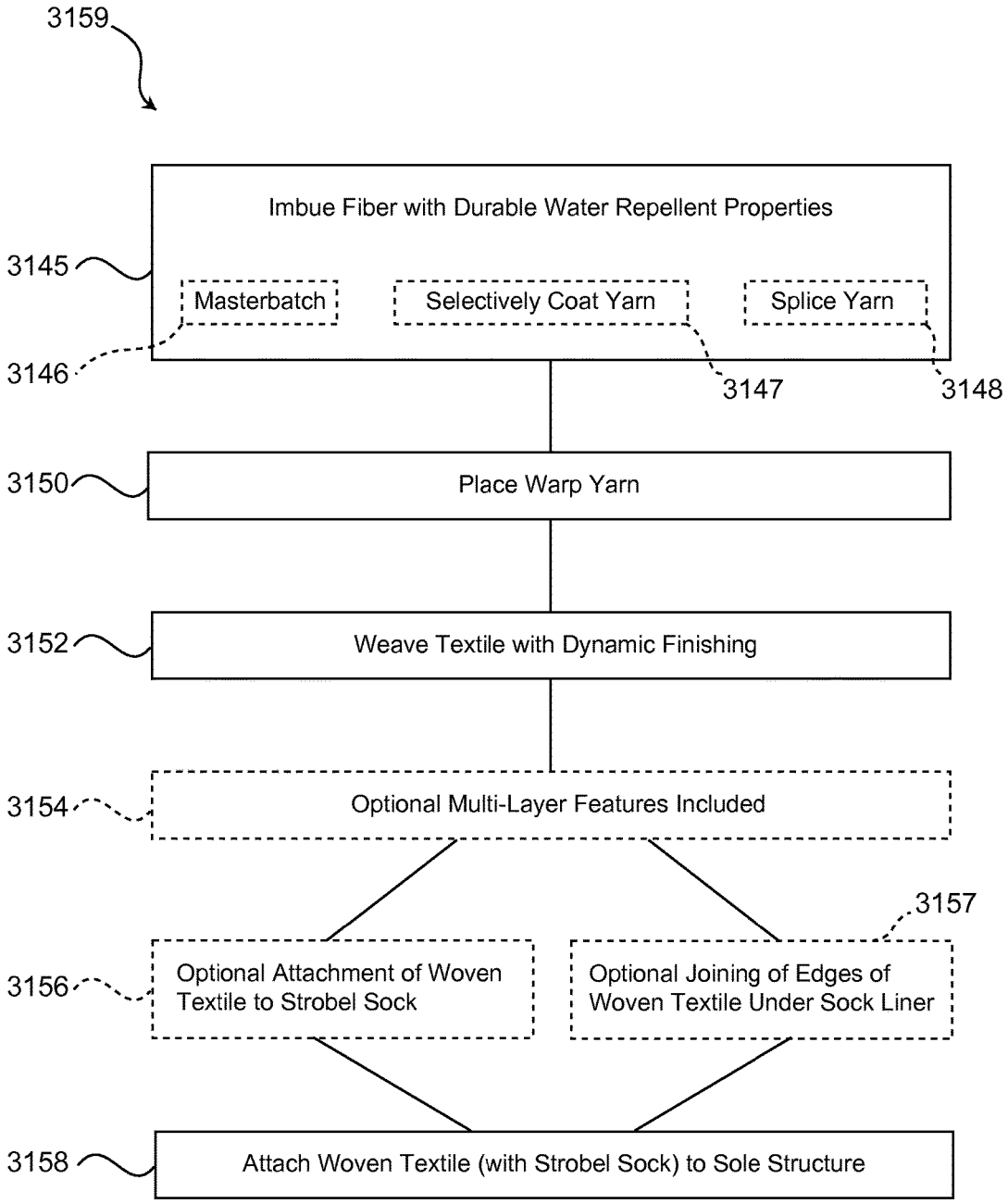
FIG. 31 is a schematic diagram of a method for manufacturing an exemplary embodiment of an article of footwear.

FIG. 31 summarizes a method 3159 for manufacturing an article of footwear including a woven textile. Yarn to be woven is imbued with durable water repellant properties at 3145 in accordance with any suitable method. Masterbatching 3146, selective yarn coating 3147, and yarn splicing 3148 are illustrated in FIG. 31. Then, warp yarns are placed in a loom 3150 and the textile is woven with dynamic finishing 3152. Optional multi-layer features may be included at 3154. Then, the woven textile may be attached to a strobel sock at 3156, or may be joined at the edges under a sockliner at 3157. The woven textile then is attached to a sole structure at 3158.

Figure 26:
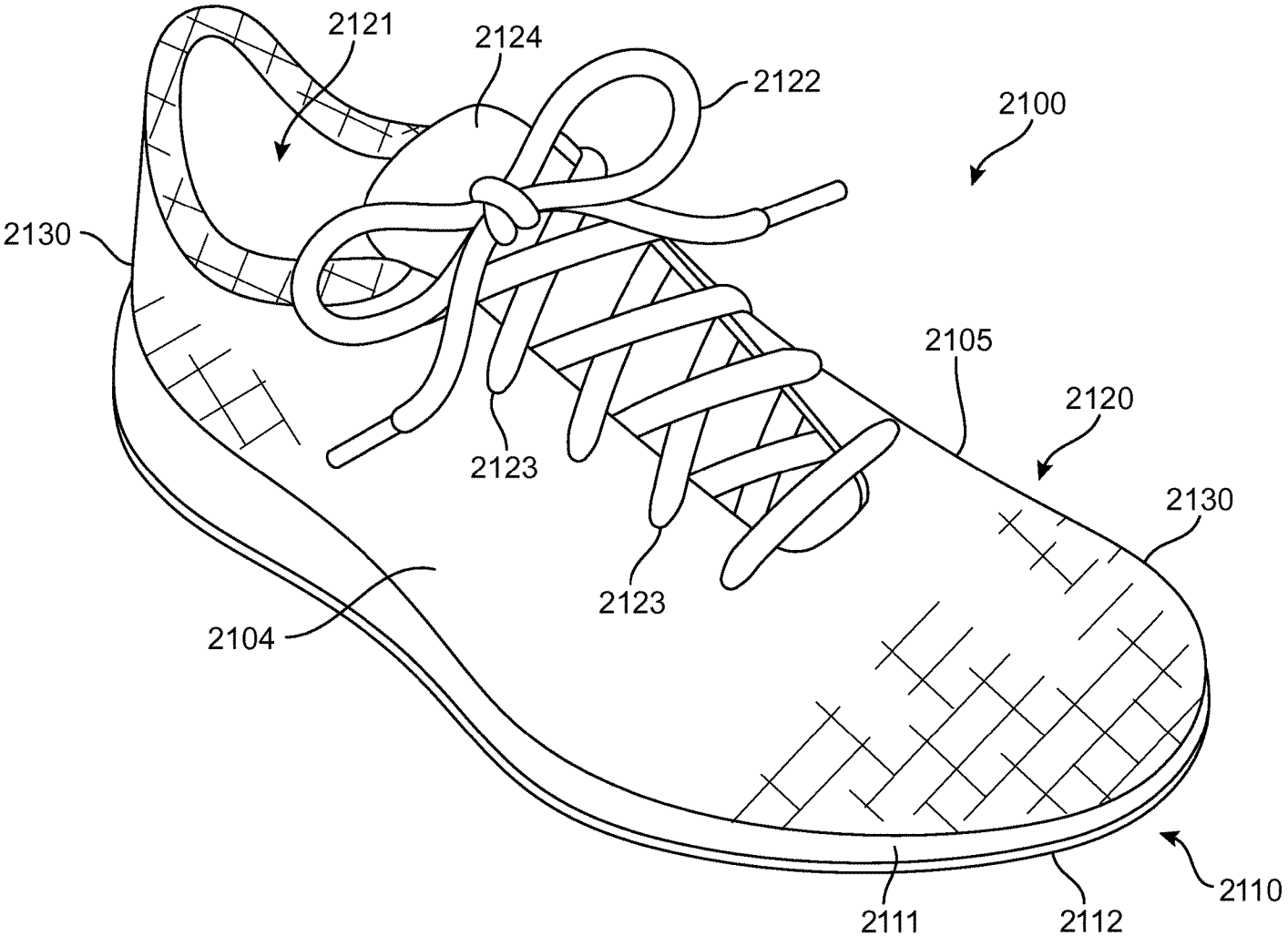
FIG. 26 is a perspective view of an exemplary embodiment of an article of footwear.

An article of footwear 2100 is depicted in FIG. 26 as including a sole structure 2110 and an upper 2120. Although footwear 2100 is illustrated as having a general configuration suitable for running, concepts associated with footwear 2100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 2100 apply to a wide variety of footwear types.

Sole structure 2110 is secured to upper 2120 and extends between the foot and the ground when footwear 2100 is worn. The primary elements of sole structure 2110 are a midsole 2111 and outsole 2112. Midsole 2111 is secured to a lower surface of upper 2120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 2111 may incorporate plates, moderators, fluid-filled chambers, lasting elements, or motion control members that further attenuate forces, enhance stability, or influence the motions of the foot, or midsole 2111 may be primarily formed from a fluid-filled chamber. Outsole 2112 is secured to a lower surface of midsole 2111 and may be formed from a wear-resistant rubber material that is textured to impart traction. Although this configuration for sole structure 2110 provides an example of a sole structure that may be used in connection with upper 2120, a variety of other conventional or nonconventional configurations for sole structure 2110 may also be utilized. Accordingly, the features of sole structure 2110 or any sole structure utilized with upper 2120 may vary considerably.

Upper 2120 defines a void within footwear 2100 for receiving and securing a foot relative to sole structure 2110. The void is shaped to accommodate the foot and extends along a lateral side of the foot, along a medial side of the foot, over the foot, around the heel, and under the foot. Access to the void is provided by an ankle opening 2121 located in at least a heel region. In some embodiments of the disclosure, lace 2122 may extend through various lace apertures 2123 in upper 2120 and permits the wearer to modify dimensions of upper 2120 to accommodate proportions of the foot. More particularly, lace 2122, if present, permits the wearer to tighten upper 2120 around the foot, and lace 2122 permits the wearer to loosen upper 2120 to facilitate entry and removal of the foot from the void (i.e., through ankle opening 2121). Collar 2143 (FIG. 27) extends around ankle opening 2121. In addition, upper 2120 may include a tongue 2124 that extends under lace 2122 and lace apertures 2123 to enhance the comfort of footwear 2100. In further configurations, upper 2120 may include additional elements, such as (a) a heel counter in a heel region that enhances stability, (b) a toe guard in a forefoot region that is formed of a wear-resistant material, and (c) logos, trademarks, and placards with care instructions and material information.

Many conventional footwear uppers are formed from multiple material elements (e.g., textiles, polymer foam, polymer sheets, leather, and synthetic leather) that are joined through stitching or bonding, for example. In contrast, in embodiments of the disclosure, a majority of upper 2120 is formed from a woven textile 2130, which extends along the article of footwear at both lateral side 2104 and medial side 2105, over a forefoot region, and around a heel region. In addition, woven textile 2130 forms portions of both an exterior surface and an opposite interior surface of upper 2120. As such, woven textile 2130 defines at least a portion of the void within upper 2120. In some configurations, woven textile 2130 may also extend under the foot.

Figure 27:
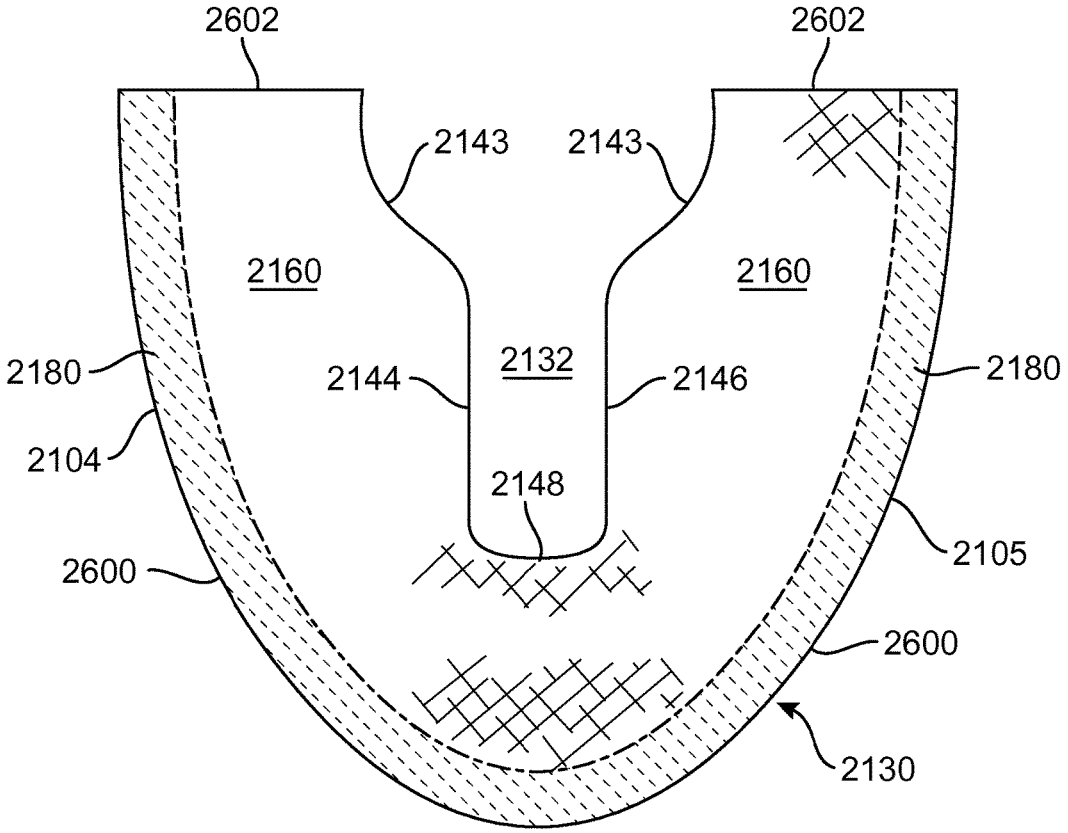
FIG. 27 is a top plan view of an exemplary embodiment of a woven textile with an area of first yarn and an area of second yarn.

FIG. 27 illustrates an exemplary embodiment wherein woven textile 2130 is adapted to be attached to a strobel sock. As can be seen, the weave pattern may be different from the weave pattern illustrated on upper 2120 on article of footwear 2100 in FIG. 26. This difference is to illustrate that, as described above, various weave patterns are suitable for use in embodiments of the disclosure.

In FIG. 27, woven textile 2130 is shown in a planar or flat configuration. In this embodiment, woven textile 2130 has a generally U-shaped configuration that is outlined by an outer perimeter edge 2600. In this embodiment outer perimeter edge 2600 extends around woven textile 2130 from lateral side 2104 to medial side 2105. The outer perimeter of woven textile 2130 also includes a pair of heel edges 2602 disposed on each of lateral side 2104 and medial side 2105. In an exemplary embodiment, woven textile 2130 may further include an inner perimeter that will be associated with and define instep area 2132. In this embodiment, the inner perimeter of woven textile 2130 includes lateral inner perimeter edge 2144 and medial inner perimeter edge 2146. Lateral inner perimeter edge 2144 and medial inner perimeter edge 2146 are disposed on opposite sides of woven textile 2130. Lateral inner perimeter edge 2144 and medial inner perimeter edge 2146 are spaced apart and define instep area 2132 of upper 2120. Additionally, the inner perimeter further includes forward edge 2148. In embodiments where article 2100 includes tongue 2124 that extends through instep area 2132, tongue 2124 maybe joined or attached to upper 2120 at forward edge 2148 of woven textile 2130.

In various embodiments, woven textile 2130 may incorporate various types of yarn that impart different properties to separate areas of upper 2120. For example, one area or portion of woven textile 2130 may be formed from a first type of yarn that imparts a first set of properties, and another area or portion of woven textile 2130 may be formed from a second type of yarn that imparts a second set of properties. In this configuration, properties may vary throughout upper 2120 by selecting specific yarns for different areas of woven textile 2130. In an exemplary embodiment, woven textile 2130 includes a first portion 2160 comprising a first yarn and a second portion 2180 comprising a second yarn different from the first yarn. As described below, woven textile 2130 may be formed of unitary woven construction such that each of the areas of woven textile 2130, including first portion 2160 and second portion 2180, are woven as a one-piece element.

Turning again to FIG. 31, durable water repellant properties may be imparted to yarn in ways similar to those already described for yarn. Yarn may be imbued with durable water repellant properties and characteristics by masterbatching 3146, by coating yarn after it is formed 3147, and in other suitable ways. In some embodiments, lengths of yarn may be selectively treated along its length with materials that provide durable water repellency before weaving so as to form first regions, with untreated lengths remaining as second regions. For example, for yarn comprising melt fiber extruded fibers, an additive component may be selectively proportioned into or onto the surface layer of the yarn. In some embodiments, durable water repellency-providing materials may be applied using a quickly-changeable extruding machine. Such a machine is designed to provide the opportunity to quickly change, for example, the color or coating on a yarn. One such system is disclosed in U.S. Pat. No. 5,516,476 to Haggard et al., and in U.S. Pat. No. 5,851,562 to Haggard et al, both of which are entirely incorporated herein by reference. The system provides the opportunity to change conditions quickly, completely, and unambiguously. Thus, such a system allows a change from untreated yarn, i.e., yarn without durable water repellant properties and characteristics, to treated yarn with durable water repellant quickly and easily.

In some embodiments, different yarns may be spliced 3148 at pre-selected positions to form a continuous yarn having different properties and characteristics. Such a spliced yarn may comprise lengths of one, two, three, or more different kinds or types of yarns that may be spliced together. Such a spliced yarn would provide regions in the non-woven textile wherein the warp or the weft would provide a particular property or characteristic.

In some embodiments, different yarns may be spliced into selected positions of a woven textile at pre-weaving positions determined to provide selected areas for which a particular property, such as durable water repellency or the absence of durable water repellant, is required in the woven textile. Splicing of yarns for this and other purposes is disclosed in United States Patent Application Publication No. 2013/0185,054 to Dua et al., the entirety of which is incorporated herein by reference.

Figure 28:
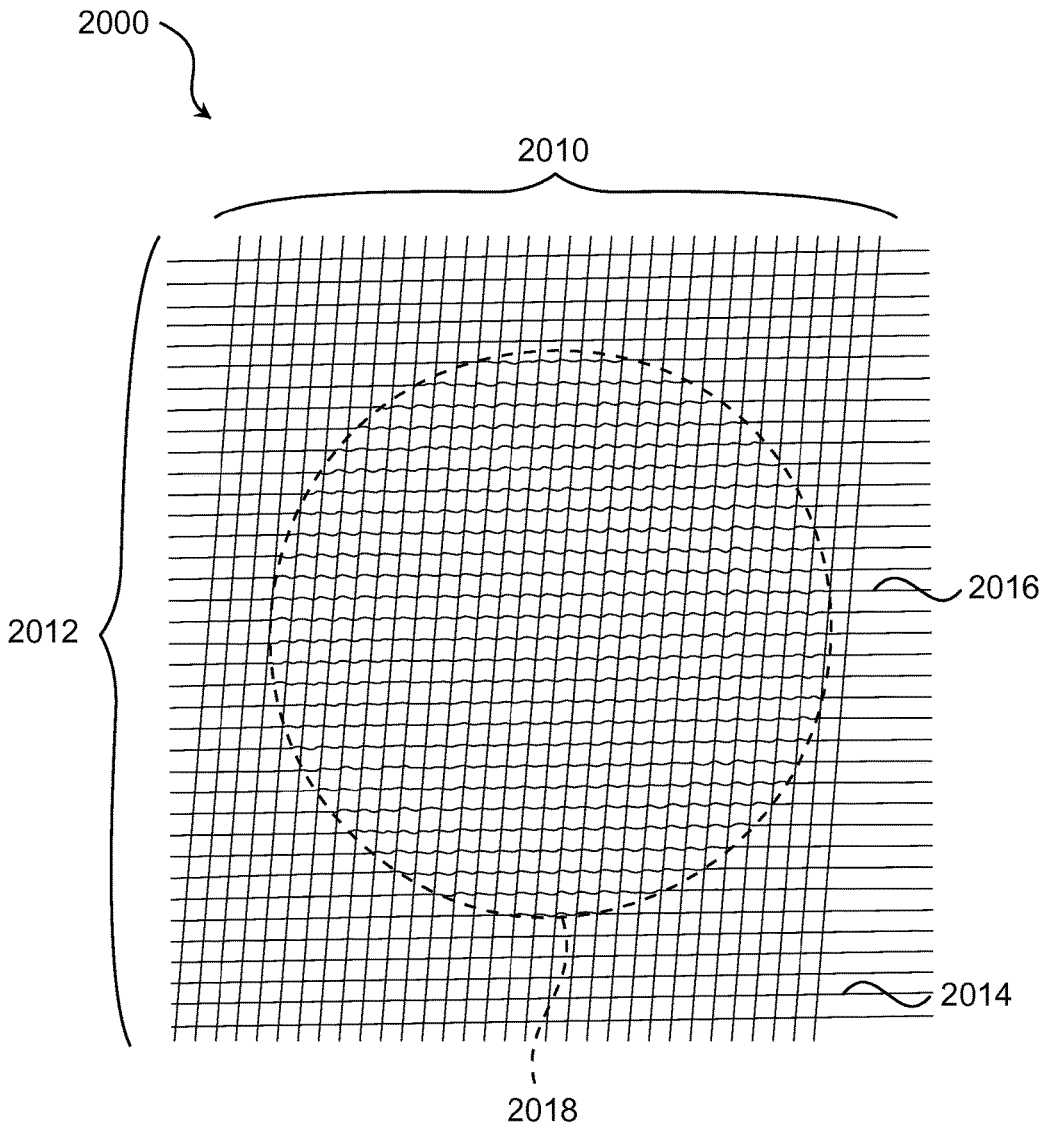
FIG. 28 is a magnified top plan view of an exemplary embodiment of a woven textile with areas of first yarn.

FIG. 28 depicts a close-up view of an exemplary woven textile 2000 that may be produced by a splicing system. Woven textile 2000 comprises a series of warp yarns 2010. The term yarn may comprise materials discussed previously, and may include polymers, natural materials, plastics, metals, and the like. Woven textile 2000 also comprises a series of weft yarns 2012. In FIG. 28, some of the weft yarns 2012 comprise combined material weft yarns generated by intermittent splicing. Yarn 2014 provides an example of a weft yarn that is comprised of one material, while yarn 2016 illustrates a weft yarn comprised of more than one material.

The weft yarns 2012 may be woven to produce an area 2018. The area 2018 may have no durable water repellant properties, whereas the remainder of the woven textile 2000 has durable water repellant properties. Area 2018 thus corresponds to a third region, providing an area without durable water repellant properties within an area having durable water repellant properties.

An intermittent splicer may be used in some embodiments to produce warp yarn having durable water repellant properties and characteristics in area 2018 or elsewhere. Further, in some embodiments, warp yarns 2010 may be imbued with durable water repellant properties and characteristics in the area 2018 but not elsewhere, in accordance with one of the other selective coating method described herein.

The shape of a woven textile, for example, in embodiments using the shape of an upper for an article of footwear, may be obtained with dynamic finishing devices for woven materials 3152. Such devices are capable of finishing one side edge of a woven textile independently of a second side edge. Such devices may be positioned within the borders of the woven textile to form features within, i.e., not at the edge, the woven textile. Such features may include apertures, such as for laces or for forming the shape of the ankle cut-out. Such devices are disclosed in U.S. Pat. No. 8,800,606 to Cross, et al., and US Published Application Number 2013/0189890 to Cross, et al. The entireties of these documents are incorporated herein by reference.

These and other features, such as tunnels in which tensile strands may be located in some embodiments, may be made in accordance with the disclosure of U.S. Patent Application Publication 2013/0186506 to Cross et al., U.S. Patent Application Publication 2013/0190917 to Cross et al., and U.S. Patent Application Publication 2014/0173933 to Bell. The entireties of these documents are incorporated herein by reference.

Multiple layer weaving, such as that described in U.S. Patent Application Publication 2013/0051706 to Roether et al., the entirety of which is incorporated herein by reference, may be used in some embodiments to include, for example, tunnels for laces or tensile strands, to add a tongue, or other multiple-layer features 3154.

The yarns used in embodiments of the disclosure may be selected from monofilament yarns and multifilament yarns formed from natural or synthetic materials. Multifilament yarns may be twisted or untwisted. In some embodiments, yarn may be elastic or essentially inelastic. In some embodiments, yarn may be textured or have a natural finish. Natural materials may be selected from staple materials, such as silk, cotton, and wool. Synthetic materials may be selected from polymers that can be formed into filaments. Synthetic materials include but are not limited to polyesters; polyamides, such as any of the various types of homopolymeric and co-polymeric nylon; aramides, such as Kevlar® and Nomex®; and urethanes, such as thermoplastic polyurethane.

In embodiments of the disclosure, the first yarn having durable water repellent properties may be selected from yarns that meet design criteria and may incorporate yarns with different deniers, materials (e.g., cotton, elastane, polyester, rayon, wool, and nylon), and degrees of twist, for example. The different types of yarns may affect the physical properties of a woven textile, including aesthetics, stretch, thickness, air permeability, and abrasion-resistance. That is, the different types of yarns may impart different properties to different areas of the woven textile. By combining various types and combinations of stitches and yarns, each area of a woven textile may have specific properties that enhance the comfort, durability, and performance of the article of footwear. In some configurations, multiple yarns with different colors may be utilized to form the woven textile. When yarns with different colors are twisted together and then woven, the woven textile may have a heathered appearance with multiple colors randomly distributed throughout. Yarns may be treated in the same way as yarn is treated to provide durable water repellant properties and characteristics.

Although the woven textiles may be utilized in a variety of products, an article of footwear that incorporates one of the woven textiles is may have essentially the same features as an article of footwear comprising a knitted component. A difference is the method by which the upper is made, but the upper may have essentially the same features, first portions, second portion, third portion, and fourth portion, as an upper comprising a knitted component. This description is directed in detail to an article of footwear. However, in addition to footwear, the woven textiles may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The woven textiles may also be utilized in bed coverings (e.g., sheets, blankets), table coverings, towels, flags, tents, sails, and parachutes. The woven textiles may be utilized as technical textiles for industrial purposes, including structures for automotive and aerospace applications, filter materials, medical textiles (e.g., bandages, swabs, and implants), geotextiles for reinforcing embankments, agrotextiles for crop protection, and industrial apparel that protects or insulates against heat and radiation. Accordingly, the woven textiles and other concepts disclosed herein may be incorporated into a variety of products for both personal and industrial purposes.

The woven textile can be formed of unitary woven construction. As used herein, the term "unitary woven construction" means that the respective component is formed as a one-piece element through a weaving process. That is, the weaving process substantially forms the various features and structures of unitary woven construction without the need for significant additional manufacturing steps or processes. A unitary woven construction may be used to form a woven textile having structures or elements that include one or more courses of yarn or other woven material that are joined such that the structures or elements include at least one yarn in common (i.e., sharing a common yarn) and/or include yarns that are substantially continuous between each of the structures or elements. With this arrangement, a one-piece element of unitary woven construction is provided.

In some embodiments, an upper is prepared for attachment to a top surface of a midsole in a sole structure by putting a strobel sock in place between the outer perimeter edges of a second portion of the upper 3156. In other embodiments, the upper is prepared by mating one side of an outer perimeter edge of the upper to the opposite side outer perimeter edge to form a surface for attachment to the top surface of the midsole. An exemplary embodiment of a method disclosed herein is illustrated in FIG. 14 for a knitted component.

In some embodiments, a woven textile upper may be joined to a strobel sock for attachment to a sole structure. The strobel sock may be stitched to the outer perimeter edge of the second portion of the woven textile, as set forth in 3156. In addition, heel edges are joined to each other and extend vertically in heel region of the woven textile upper to form a seam. FIG. 5 illustrates such a construction for a knitted component.

In some embodiments, a strobel sock is not used. Rather, the second portion is formed so that an outer perimeter edge may be joined under a sockliner, as set forth in 3157. In such embodiments, the second portion of the woven textile is wider than the corresponding portion for use with a strobel because the stitched-together second portion essentially spans the width of the article of footwear. Such a configuration is illustrated for a knitted component in FIG. 9.

Adhesive then may be applied to one or both of the surfaces to be adhered. Adhesive may be applied in any manner, such as by brushing, wiping, direct application from a nozzle or spray head. In one embodiment, adhesive may be applied to the top surface of the midsole. In some cases, adhesive may additionally be applied or extend to the sides or lip of the sole structure that are raised above the top surface. Then, the upper and sole structure are moved together and are pressed together for a time sufficient to form a bond. Adhesive may cure after an initial bond is formed.

In some embodiments, a third portion having yarn that does not have durable water repellence may be included within the first portion. Such a third portion may, for example be useful as an area to which a water-based materials may be applied to form an indicium such as a word, a symbol, a shape, or a design. A third portion may take the shape of an arrow, any symbol, or any shape or shapes, and may be formed anywhere on the upper.

In some embodiments, a fourth portion having yarn that has durable water repellant properties may be included in a rand, an area vertically above the biteline on the outside of the upper of an article of footwear. In some embodiments, both a third portion and a fourth portion may be present.

Durable water repellence-providing compositions on yarn will cause water to be repelled, whereas water will not be repelled from the same yarn devoid of durable water repellence-providing material. Water forms beads on yarns having durable water repellant properties. In some embodiments, the contact angle, i.e., the angle formed between the water drop and the surface of the woven textile, is at least about 90°. In contrast, water spreads and forms puddles rather than drops on untreated yarn. The contact angle of puddles on untreated yarn is less than about 90°, and typically may be less than or equal to about 45°. Low contact angles, i.e., angles less than about 90°, allow water-based adhesive to bind with untreated yarn of a woven textile for attaching elements, such as a sole structure or other components, to a woven textile.

Non-Woven Textiles

The principles of the disclosure have been described above in detail relating to embodiments with respect to knitted components and woven textile. These principles may be similarly applied to non-woven textile and non-woven components for incorporation into, for example, an article of footwear.

In one aspect, the disclosure provides a non-woven textile for an upper of an article of footwear. The non-woven textile includes a first portion formed by a first fiber, the first fiber having durable water repellent properties. The non-woven textile also has a second portion formed by a second fiber. The second fiber is different from the first fiber. The second fiber is disposed along an edge portion of the non-woven textile configured to be attached to the sole structure. The non-woven textile including the first portion and the second portion is formed of unitary non-woven construction.

In another aspect, the disclosure comprises an article of footwear having an upper and a sole structure secured to the upper. The upper comprises a non-woven textile formed of unitary non-woven construction. The non-woven textile comprises a first portion formed by a first fiber having durable water repellent properties. The non-woven textile has a second portion formed by a second fiber, the second fiber being different from the first fiber. The second fiber is disposed along an edge portion of the non-woven textile configured to be attached to the sole structure.

The disclosure provides a method of manufacturing a non-woven textile for an upper of an article of footwear having an upper and a sole structure. The method includes manufacturing a first portion of the non-woven textile with a first fiber, the first fiber having durable water repellent properties, and manufacturing a second portion of the non-woven textile formed by a second fiber, the second fiber being different from the first fiber. The second portion is disposed along an edge portion of the non-woven textile and is configured to be attached to the sole structure.

The disclosure also provides a method of manufacturing an article of footwear having an upper and a sole structure. The method comprises manufacturing a non-woven textile formed of a unitary non-woven construction for incorporation into the upper. A first portion of the non-woven textile is formed by first fiber, the first fiber having durable water repellent properties. A second portion of the non-woven textile disposed along an edge portion of the non-woven textile and configured to be attached to the sole structure is formed by a second fiber. The second fiber is different from the first fiber. The sole structure is attached to the second portion of the non-woven textile.

Figure 32:
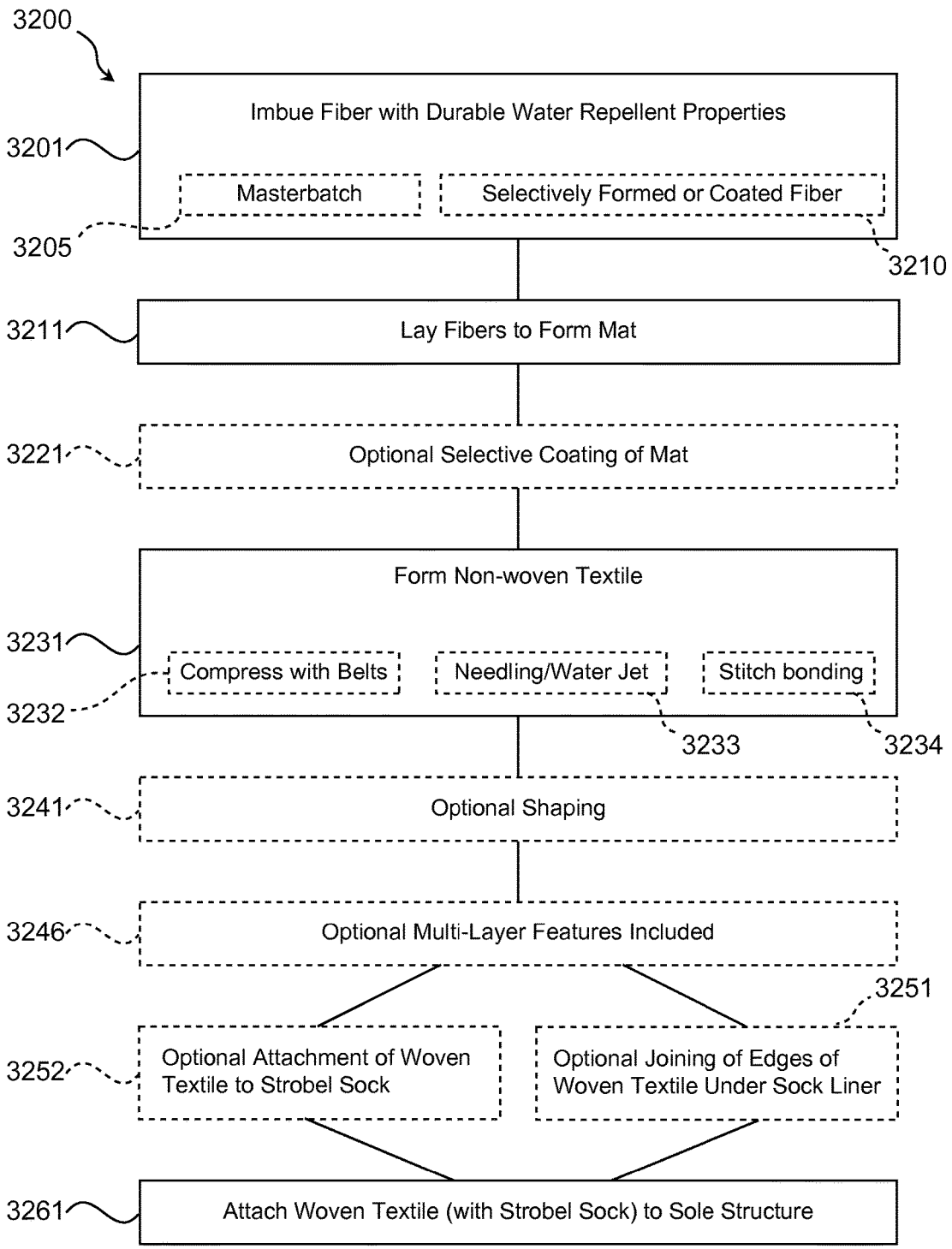
FIG. 32 is a schematic diagram of a method for manufacturing an exemplary embodiment of an article of footwear

FIG. 32 summarizes a method 3200 for manufacturing an article of footwear including a non-woven textile. Fiber may be imbued with durable water repellant properties at 3201 in accordance with any suitable method. Masterbatching 3205 and selective fiber forming or coating 3210 are illustrated in FIG. 32. Fibers are laid to form a mat at 3211. The mat may be selectively coated, i.e., coated in pre-selected areas to form first portions and second portions. The mat may be formed into a non-woven textile at 3231 in any suitable way. For example, the mat may be compressed with belts 3232, needled or subjected to water jetting 3233, or stitch bonded 3234. In some embodiments, a composition imbuing durable water repellant-properties may be included in water used in water-jetting during formation of the mat. In some embodiments, imbuing durable water repellant-properties during water-jetting may be an alternative to imbuing durable water repellant properties in step 3201. In some embodiments, durable water repellant-material may be directed to selected nozzles to imbue durable water repellant properties to selected areas of the non-woven fabric.

In some embodiments, it may be appropriate to cut, slice, or otherwise shape the non-woven textile at 3241. Optional multi-layer features may be included at 3264. Then, the non-woven textile may be attached to a strobel sock at 3252, or may be joined at the edges under a sockliner at 3251. The non-woven textile then is attached to a sole structure at 3261.

Figure 29:
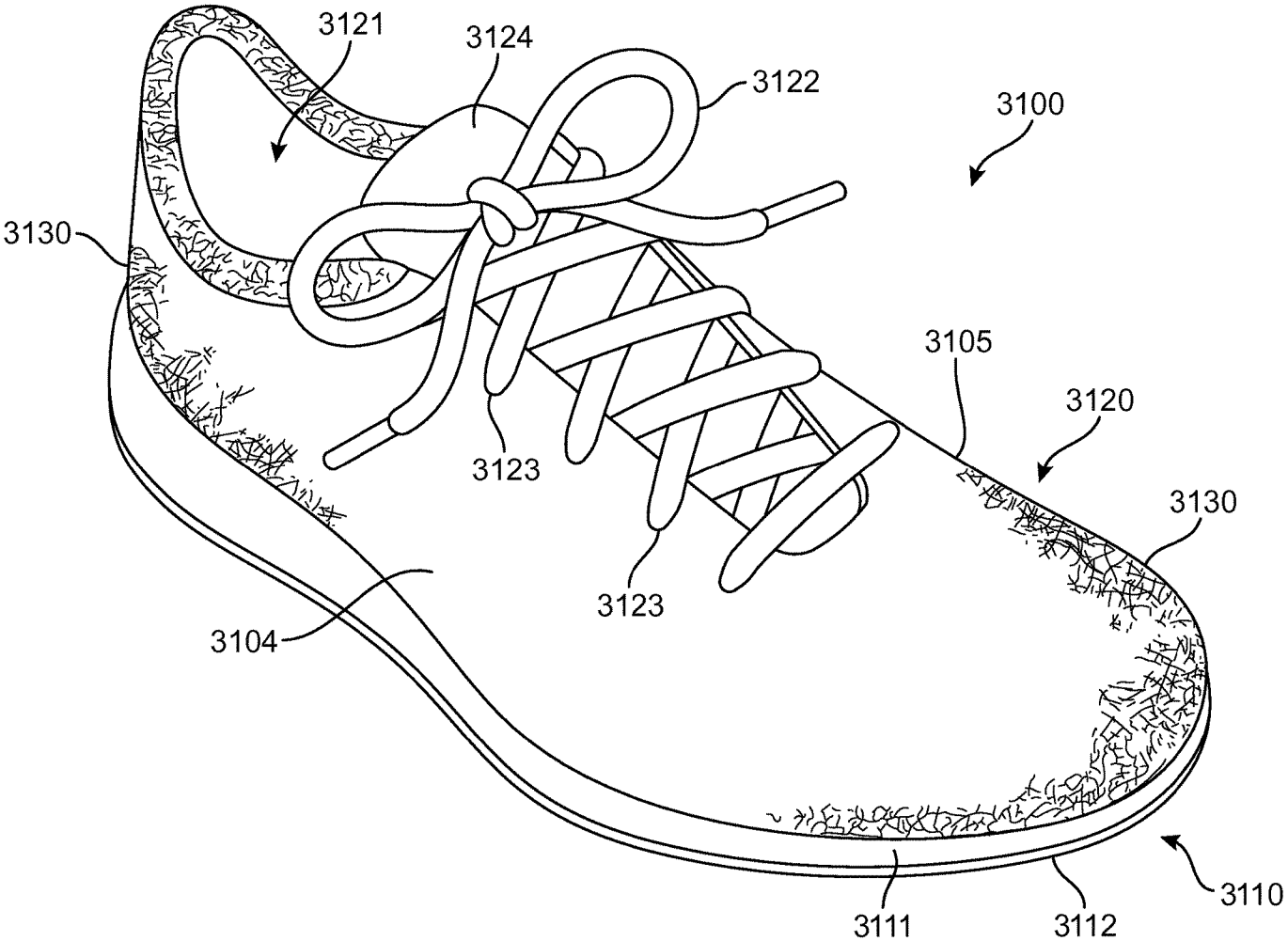
FIG. 29 is a perspective view of an exemplary embodiment of an article of footwear.

An article of footwear 3100 is depicted in FIG. 29 as including a sole structure 3110 and an upper 3120. Although footwear 3100 is illustrated as having a general configuration suitable for running, concepts associated with footwear 3100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 3100 apply to a wide variety of footwear types.

Sole structure 3110 is secured to upper 3120 and extends between the foot and the ground when footwear 3100 is worn. The primary elements of sole structure 3110 are a midsole 3111 and outsole 3112. Midsole 3111 is secured to a lower surface of upper 3120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 3111 may incorporate plates, moderators, fluid-filled chambers, lasting elements, or motion control members that further attenuate forces, enhance stability, or influence the motions of the foot, or midsole 3111 may be primarily formed from a fluid-filled chamber. Outsole 3112 is secured to a lower surface of midsole 3111 and may be formed from a wear-resistant rubber material that is textured to impart traction. Although this configuration for sole structure 3110 provides an example of a sole structure that may be used in connection with upper 3120, a variety of other conventional or nonconventional configurations for sole structure 3110 may also be utilized. Accordingly, the features of sole structure 3110 or any sole structure utilized with upper 3120 may vary considerably.

Upper 3120 defines a void within footwear 3100 for receiving and securing a foot relative to sole structure 3110. The void is shaped to accommodate the foot and extends along a lateral side of the foot, along a medial side of the foot, over the foot, around the heel, and under the foot. Access to the void is provided by an ankle opening 3121 located in at least a heel region. In some embodiments of the disclosure, lace 3122 may extend through various lace apertures 3123 in upper 3120 and permits the wearer to modify dimensions of upper 3120 to accommodate proportions of the foot. More particularly, lace 3122, if present, permits the wearer to tighten upper 3120 around the foot, and lace 3122 permits the wearer to loosen upper 3120 to facilitate entry and removal of the foot from the void (i.e., through ankle opening 3121). Collar 3143 (FIG. 30) extends around ankle opening 3121. In addition, upper 3120 may include a tongue 3124 that extends under lace 3122 and lace apertures 3123 to enhance the comfort of footwear 3100. In further configurations, upper 3120 may include additional elements, such as (a) a heel counter in a heel region that enhances stability, (b) a toe guard in a forefoot region that is formed of a wear-resistant material, and (c) logos, trademarks, and placards with care instructions and material information.

Many conventional footwear uppers are formed from multiple material elements (e.g., textiles, polymer foam, polymer sheets, leather, and synthetic leather) that are joined through stitching or bonding, for example. In contrast, in embodiments of the disclosure, a majority of upper 3120 is formed from a non-woven textile 3130, which extends along the article of footwear at both lateral side 3104 and medial side 3105, over a forefoot region, and around a heel region. In addition, non-woven textile 3130 forms portions of both an exterior surface and an opposite interior surface of upper 3120. As such, non-woven textile 3130 defines at least a portion of the void within upper 3120. In some configurations, non-woven textile 3130 may also extend under the foot.

Figure 30:
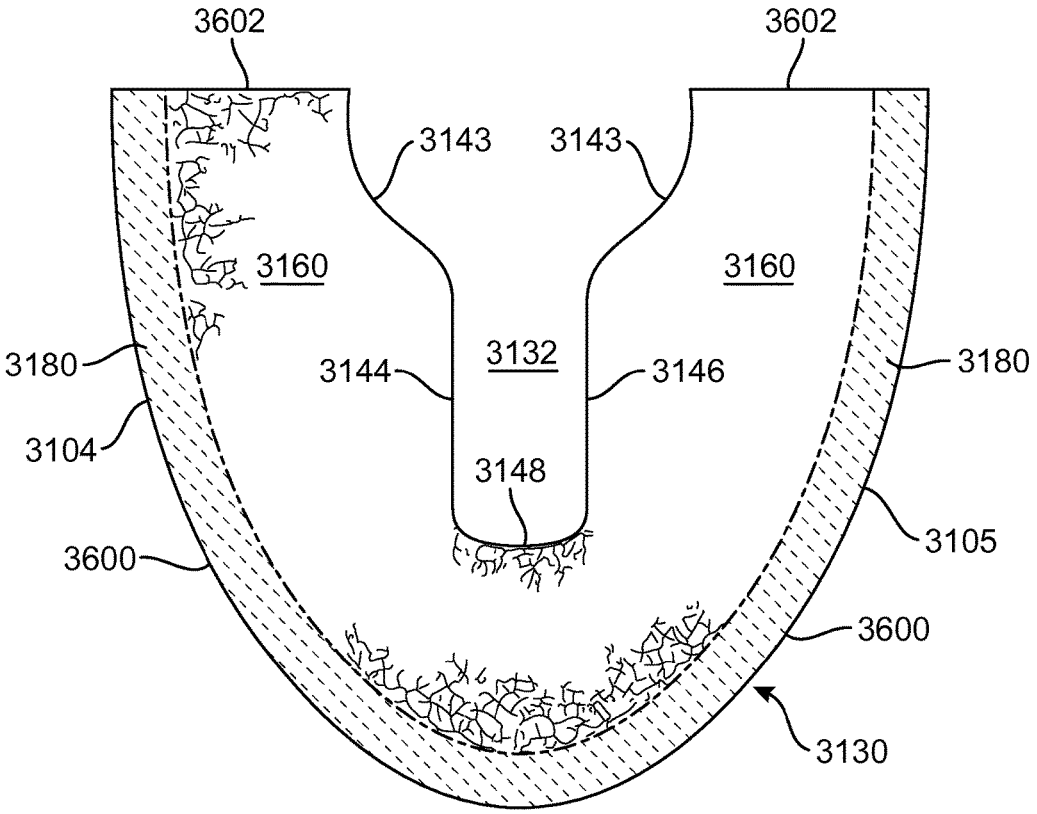
FIG. 30 is a top plan view of an exemplary embodiment of a knitted component with an area of first fiber and an area of second fiber.

FIG. 30 illustrates an exemplary embodiment wherein non-woven textile 3130 is adapted to be attached to a strobel sock. In FIG. 30, non-woven textile 3130 is shown in a planar or flat configuration. In this embodiment, non-woven textile 3130 has a generally U-shaped configuration that is outlined by an outer perimeter edge 3600. In this embodiment, outer perimeter edge 3600 extends around non-woven textile 3130 from lateral side 3104 to medial side 3105. The outer perimeter of non-woven textile 3130 also includes a pair of heel edges 3602 disposed on each of lateral side 3104 and medial side 3105. In an exemplary embodiment, non-woven textile 3130 may further include an inner perimeter that will be associated with and define instep area 3132. In this embodiment, the inner perimeter of non-woven textile 3130 includes lateral inner perimeter edge 3144 and medial inner perimeter edge 3146. Lateral inner perimeter edge 3144 and medial inner perimeter edge 3146 are disposed on opposite sides of non-woven textile 3130. Lateral inner perimeter edge 3144 and medial inner perimeter edge 3146 are spaced apart and define instep area 3132 of upper 3120. Additionally, the inner perimeter further includes forward edge 3148. In embodiments where article 3100 includes tongue 3124 that extends through instep area 3132, tongue 3124 maybe joined or attached to upper 3120 at forward edge 3148 of non-woven textile 3130.

In various embodiments, non-woven textile 3130 may incorporate various types of fiber that impart different properties to separate areas of upper 3120. For example, one area or portion of non-woven textile 3130 may be formed from a first type of fiber that imparts a first set of properties, and another area or portion of non-woven textile 3130 may be formed from a second type of fiber that imparts a second set of properties. In this configuration, properties may vary throughout upper 3120 by selecting specific fibers for different areas of non-woven textile 3130. In an exemplary embodiment, non-woven textile 3130 includes a first portion 3160 comprising a first fiber and a second portion 3180 comprising a second fiber different from the first fiber. As described below, non-woven textile 3130 may be formed of unitary non-woven construction such that each of the areas of non-woven textile 3130, including first portion 3160 and second portion 3180, are manufactured as a one-piece element.

Non-woven textiles may comprise fibers typically bonded together by chemical, mechanical, heat, or solvent treatment. Non-woven textiles are neither woven nor knitted. Non-woven textiles may lack strength unless densified or reinforced by a backing. Fibers in non-woven textiles may be oriented or randomly arranged. Non-woven textiles may comprise one or more type of fiber. In some embodiments, the fibers used in non-woven textiles are the same as those used to make yarn for woven textiles and for the knitted component.

Fibers may be not closely entangled or may be obtained compressed in, for example, bales. If the fiber is not closely entangled, opening of the fiber may not be necessary. However, fiber obtained from other sources typically may be baled for ease in handling. Fibers that have been baled typically are 'opened' before further processing. Opening begins the fiber separation process.

Fibers then may be carded or air-laid to form a mat 3211. Carding is a mechanical process that disentangles, cleans, and intermixes fibers to produce a continuous web suitable for subsequent processing. This may be achieved by passing the fibers between differentially moving surfaces covered with card clothing. Carding breaks up blocks and unorganized clumps of fiber and then aligns the individual fibers to be essentially parallel with each other.

The orientation created by carding may be effectively improved by capturing fibers on a screen from an air-stream. Starting with a lap or plied card webs fed by a feed roller, the fibers are separated and introduced into an air-stream.

The total randomization may exclude any preferred orientation when the fibers are collected on the condenser screen. The web is delivered to a conveyor for transporting to the bonding area. The length of fibers used in air-laying varies from about 2 to about 6 cm. The shorter lengths allow higher production speeds. Longer fibers require higher air volume, i.e., a lower fiber density to avoid tangling. Air-laying is slower than carding and, hence, more expensive.

Fibers comprising non-woven textile in some embodiments herein may be selected from compositions already identified herein. Fibers may have a diameter of about 20 microns or less, typically about 15 microns or less, and more typically about 10 microns or less. The length of the fibers may be between about 0.5 inches and about 6 inches, more typically between about 0.75 inches and about 4 inches. Typically it may be necessary to chop the fiber to obtain the desired length.

Dry-laid fiber may be punched with needles that entangle fibers sufficiently to maintain the structural integrity of the web. Air jets and water jets also may be used to entangle the fibers, but such jets typically may not be as efficient and durable. However, in some embodiments, a water jet may be used to both entangle the fibers and to apply durable water repellant composition.

In some embodiments, durable water repellant composition may be applied by the water jet when laminating with any knitted component, woven textile, or non-woven textile.

As used herein, 'fiber' may include polymeric compositions that are melt-blown. Melt blowing is a process for producing fibrous webs or articles directly from polymers or resins using high-velocity air or another appropriate force to attenuate the filaments. This process is used almost exclusively to produce microfibers rather than fibers the size of normal textile fibers. Melt blown microfibers generally may have diameters in the range of about 2 microns to about 4 μm, although they may be as small as about 0.1 μm and as large as about 10 microns to about 15 μm. Differences between properties and characteristics of non-woven textiles formed from melt blown fibers and other nonwoven fabrics, such as degree of softness, cover or opacity, and porosity, can generally be traced to differences in filament size.

A melt blowing process is a one-step process in which high-velocity air blows a molten thermoplastic resin from an extruder die tip onto a conveyor or takeup screen to form a fine fibrous and self-bonding web. Webs formed by carding or by air laying may require that adhesive fibers be mixed into the web, and that the web then be heated to affix the fibers. Alternatively, adhesive may be required for carded or air-laid mats.

Hot, high-velocity air streams move the molten resin from the extruder to the conveyor. The fibers may be generally laid randomly and also highly entangled because of the turbulence in the air stream. Durable water repellant properties may be included in the fiber during the extrusion process. In particular, the 'quick change' apparatus may be used to localize durable water repellant properties and form a portion of the non-woven textile that has durable water repellant properties, whereas other portions of the non-woven textile do not have durable water repellant properties, as shown in 3210. The entirety of the fiber may be imbued with durable water repellant properties by using a masterbatch, as shown in 3205.

Although most nonwovens are considered finished when they are rolled up at the end of the production line, many may receive additional chemical or physical treatment such as calendaring, embossing, and flame retardance. Some of these treatments can be applied during production, while others must be applied in separate finishing operations. Durable water repellant may be applied in fixed areas.

In some embodiments, the web may comprise polypropylene. In some embodiments, the web may comprise a polyamide, such as a nylon, a polycarbonate, or polystyrene. In other embodiments, the materials already identified for yarn and thread also may be suitable for forming fibers having a diameter of about 20 microns or less, typically about 15 microns or less, and even more typically about 10 microns or less.

In some embodiments, durable water repellence properties may be applied to an area of the resultant fiber bat, whether before or after the bat is consolidated, as shown at 3221.

In some embodiments, fiber for the non-woven textile is spun-bonded. Spunbond non-woven textiles are produced by depositing extruded, spun filaments onto a collecting belt in a uniform but random manner followed by bonding of the fibers. The fibers typically have a diameter between about 5 microns and about 50 microns, more typically between about 10 microns and about 40 microns.

In some embodiments, the fiber mat may be pressed to ensure bonding of the fibers. The skilled practitioner recognizes that the web may be pressed in any manner known. One such pressing system is a pair of compression belts, as in 3232. Compression belts are continuous belts that converge in the direction of movement, i.e., they come closer together so as to impinge upon and press an object between them. In such a system, the web is placed between the compression belts where they are farther apart and is pressed and consolidated as the belts converge. The web thickness thus is reduced, and a bound web of pre-selected thickness equal to the space between the belts is removed from the end where the belts are closest together. Thus, for example, the belts pass through an oven while the web is heated and pressed, or the belts pass the web past a point heat source.

Needling and water jetting 3233 also may be used to increase adherence of the mat. Both techniques are known to the skilled practitioner. In needling, needles, typically closely spaced, are forced into the mat. Typically, the needles are parallel to the mat. The needles have upward-pointing hooks the pull fibers through the mat as the needles are pulled out of the mat. Alternatively, water jets may be used to entwine fibers through the mat.

In some embodiments, non-woven textile having a specific weight of as much as 100 g/m$^2$, may be stitch-bonded, such as at 3234. In some embodiments, stitch-bonded non-woven textile may comprise fibers imbued with durable water repellant properties. Stitch bonding is similar to needling, and does not place any stitches in the non-woven textile. Rather, a thread is passed through the length, but not through the entirety of the depth, of the non-woven textile. The effect is a non-woven textile as flexible and soft as the unbonded non-woven textile. This technique may provide the opportunity to provide a loop on the surface of the non-woven textile. Such a loop may be useful to restrain a tensile strand, for example. Loops also may be used to provide durable water repellant surfaces, and may be located in a selected location.

As described above, fibers used in embodiments of the disclosure typically may be selected from monofilament fibers formed from natural or synthetic materials. In some embodiments, fibers may be elastic or essentially inelastic. In some embodiments, fibers may be textured or have a natural finish. Natural materials may be selected from staple materials, such as silk, cotton, and wool. Synthetic materials may be selected from polymers that can be formed into filaments. Synthetic materials include but are not limited to polyesters; polyamides, such as any of the various types of homopolymeric and co-polymeric nylon; aramides, such as Kevlar® and Nomex®; and urethanes, such as thermoplastic polyurethane. Many of these compositions may be suitably melt-blown to form a non-woven textile.

In embodiments of the disclosure, the first fiber having durable water repellent properties may be selected from fibers that meet design criteria and may incorporate fibers with different deniers and materials (e.g., cotton, elastane, polyester, rayon, wool, and nylon), for example. The different types of fibers may affect the physical properties of a non-woven textile, including aesthetics, stretch, thickness, air permeability, and abrasion-resistance. That is, the different types of fibers may impart different properties to different areas of the non-woven textile. By combining various types and combinations of fibers and treatments, such as needling or stitch bonding, each area of a non-woven textile may have specific properties that enhance the comfort, durability, and performance of the article of footwear. In some configurations, multiple fibers with different colors may be utilized to form the non-woven textile. Fibers may be treated in the same way as yarn and thread are treated to provide durable water repellant properties and characteristics.

Although the non-woven textiles may be utilized in a variety of products, an article of footwear that incorporates one of the woven textiles is may have essentially the same features as an article of footwear comprising a knitted component. A difference is the method by which the upper is made, but the upper may have essentially the same features, first portions, second portion, third portion, and fourth portion, as an upper comprising a knitted component. This description is directed in detail to an article of footwear. However, in addition to footwear, the non-woven textiles may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The non-woven textiles may also be utilized in bed coverings (e.g., sheets, blankets), table coverings, towels, flags, tents, sails, and parachutes. The non-woven textiles may be utilized as technical textiles for industrial purposes, including structures for automotive and aerospace applications, filter materials, medical textiles (e.g., bandages, swabs, and implants), geotextiles for reinforcing embankments, agro-textiles for crop protection, and industrial apparel that protects or insulates against heat and radiation. Accordingly, the non-woven textiles and other concepts disclosed herein may be incorporated into a variety of products for both personal and industrial purposes.

Non-woven textiles have a unitary construction, as they may comprise fibers that typically may be assembled in a group in a single operation. The formulation of the fiber may bay require only heating as a treatment after a mat is formed, not unlike some embodiments relating to knitted components. However, in some embodiments, it may be necessary to form apertures or other features by other processes. Sewing, such as sewing on a strobel sock, remains straightforward.

It may be appropriate to shape a non-woven textile into the desired form, as shown in 3241. Although fiber content may be manipulated to deposit durable water repellant fiber and fiber not having durable water repellant properties in appropriate locations, whether by changing the fiber during mat formation or by spraying the mat or the non-woven textile after formation, it may be appropriate to separately recover non-woven textile shaped as shown in FIG. 30, for example. Shaping may be carried out by cutting or shearing, whether with water, scissors or other shears, knives, or other shaping instruments.

In some embodiments, a non-woven textile upper may be joined to a strobel sock for attachment to a sole structure. The strobel sock may be stitched to the outer perimeter edge of the second portion of the non-woven textile. In addition, heel edges are joined to each other and extend vertically in heel region of the non-woven textile upper to form a seam. FIG. 5 illustrates such a construction for a knitted component.

In some embodiments, a strobel sock is not used. Rather, the second portion is formed so that an outer perimeter edge may be joined under a sockliner. In such embodiments, the second portion of the non-woven textile is wider than the corresponding portion for use with a strobel because the stitched-together second portion essentially spans the width of the article of footwear. Such a configuration is illustrated for a knitted component in FIG. 9.

In some embodiments, an upper is prepared for attachment to a top surface of a midsole in a sole structure by putting a strobel sock in place between the outer perimeter edges of a second portion of the upper. In other embodiments, the upper is prepared by mating one side of an outer perimeter edge of the upper to the opposite side outer perimeter edge to form a surface for attachment to the top surface of the midsole. An exemplary embodiment of a method disclosed herein is illustrated in FIG. 14 for a knitted component.

Adhesive then may be applied to one or both of the surfaces to be adhered. Adhesive may be applied in any manner, such as by brushing, wiping, direct application from a nozzle or spray head. In one embodiment, adhesive may be applied to the top surface of the midsole. In some cases, adhesive may additionally be applied or extend to the sides or lip of the sole structure that are raised above the top surface. Then, the upper and sole structure are moved together and are pressed together for a time sufficient to form a bond. Adhesive may cure after an initial bond is formed.

In some embodiments, a third portion having fiber that does not have durable water repellence may be included within the first portion. Such a third portion may, for example be useful as an area to which a water-based materials may be applied to form an indicium such as a word, a symbol, a shape, or a design. A third portion may take the shape of an arrow, any symbol, or any shape or shapes, and may be formed anywhere on the upper.

In some embodiments, a fourth portion having fiber that has durable water repellant properties may be included in a rand, an area vertically above the biteline on the outside of the upper of an article of footwear. In some embodiments, both a third portion and a fourth portion may be present.

Durable water repellence-providing compositions on fiber will cause water to be repelled, whereas water will not be repelled from the same fiber devoid of durable water repellence-providing material. Water forms beads on fiber having durable water repellant properties. In some embodiments, the contact angle, i.e., the angle formed between the water drop and the surface of the non-woven textile, is at least about 90°. In contrast, water spreads and forms puddles rather than drops on untreated fiber. The contact angle of puddles on untreated fiber is less than about 90°, and typically may be less than or equal to about 45°. Low contact angles, i.e., angles less than about 90°, allow water-based adhesive to bind with untreated fiber of a non-woven textile for attaching elements, such as a sole structure or other components, to a non-woven textile.

Although embodiments of the disclosure have been described in detail as providing an upper comprising a single layer, the disclosure also contemplates uppers having plural layers, as shown at 3246. The plural layers may be fused, double-knit, woven, woven with more than one layer, or otherwise associated with each other. However, the second portion, which may include the "bite line," may be only one layer. In some embodiments of an article of footwear, the bite line may extend about 5 mm from the outer periphery of the first portion and the second portion may extend a substantially similar distance of 5 mm so as to correspond to the location of the bite line. In other embodiments of the disclosure, edges of the second portion may be joined under the sockliner. In that case, the second portion may extend more than about 5 mm from the outer periphery of the first portion.

The exemplary embodiments described herein may assist with saving time in assembly of an article of footwear. Typically, after the upper is attached to a strobel, an operator draws a line to indicate the extent of the bite line to limit where adhesive is to be applied before joining the sole structure to the upper. Any visible markings then may be removed, such as by washing. According to the exemplary embodiments, it may not be necessary to draw, or to later remove, any line because the difference in yarn, thread, or fiber type between the first portion and the second portion provides a clear indication of the extent of the bite line.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear having a one-piece upper and a sole structure secured to the upper, the upper comprising a non-woven textile, wherein the non-woven textile is formed from a one-piece non-woven construction, the non-woven textile comprising: a first portion formed by a first fiber, the first fiber having durable water repellant properties; and a second portion formed by a second fiber, the second fiber being different from the first fiber; wherein the first portion is a single continuous region extending from a lateral side to a medial side of the article of footwear and wherein the second portion is a single continuous region extending around an outer peripheral perimeter edge of the first portion, and wherein the second portion is disposed along an edge portion of the upper configured to be attached to the sole structure.

2. The article of footwear of claim 1, wherein the upper is secured to the sole structure by an adhesive.

3. The article of footwear of claim 1, further comprising a strobel sock, wherein the second portion further comprises an outer perimeter edge, wherein the outer perimeter edge is attached to a strobel sock.

4. The article of footwear of claim 1, wherein the second portion further comprises a lateral side, a medial side, and an outer perimeter edge, wherein the outer perimeter edge on the lateral side and the outer perimeter edge on the medial side are attached to each other.

5. The non-woven textile of claim 1, further comprising a third portion formed by a third fiber, wherein the third fiber is different from the first fiber.

6. The textile of claim 5, further comprising a third portion not having durable water repellant properties.

* * * * *